US011644229B2

(12) United States Patent
Gupta et al.

(10) Patent No.: US 11,644,229 B2
(45) Date of Patent: May 9, 2023

(54) COOLING ASSEMBLY FOR REFRIGERATOR APPLIANCE

(71) Applicant: WHIRLPOOL CORPORATION, Benton Harbor, MI (US)

(72) Inventors: Deepak Gupta, Varese (IT); Andrea Olivani, Milan (IT); Matteo Parnisari, Biandronno (IT); Giorgio Sabatin, Varese (IT); Vincenzo Sammartano, Varese (IT); Niccoló Beretta, Milan (IT); Dennis Ilare, Milan (IT); Alessandro Mansutti, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 170 days.

(21) Appl. No.: 17/147,568

(22) Filed: Jan. 13, 2021

(65) Prior Publication Data

US 2021/0231358 A1 Jul. 29, 2021

Related U.S. Application Data

(60) Provisional application No. 62/966,643, filed on Jan. 28, 2020.

(51) Int. Cl.
*F25D 17/06* (2006.01)
*F25B 39/02* (2006.01)

(52) U.S. Cl.
CPC ..... *F25D 17/067* (2013.01); *F25B 39/02* (2013.01)

(58) Field of Classification Search
CPC .. F25D 17/067; F25D 11/02; F25D 2317/067; F25D 17/045; F25B 39/02
See application file for complete search history.

(56) References Cited

U.S. PATENT DOCUMENTS

| | | | |
|---|---|---|---|
| 5,092,136 | A | 3/1992 | Kang |
| 5,642,628 | A | 7/1997 | Whipple, III et al. |
| 5,758,512 | A | 6/1998 | Peterson et al. |
| 5,899,083 | A | 5/1999 | Peterson et al. |
| 5,899,090 | A | 5/1999 | Lyu |
| 6,722,144 | B2 | 4/2004 | Johnson |
| 10,228,180 | B2 | 3/2019 | Oyu et al. |
| 10,386,107 | B2 | 8/2019 | Xia et al. |
| 10,520,238 | B2 | 12/2019 | Li et al. |

(Continued)

FOREIGN PATENT DOCUMENTS

| | | |
|---|---|---|
| CN | 104879985 | 9/2015 |
| CN | 205014738 | 2/2016 |

(Continued)

*Primary Examiner* — Ana M Vazquez
(74) *Attorney, Agent, or Firm* — Price Heneveld LLP

(57) ABSTRACT

A refrigerator appliance includes a cabinet that defines first and second compartments. A fan assembly is configured to direct cooled air from a cooling assembly into the first and second compartments. The fan assembly includes a housing that defines an inlet, a first outlet, and a second outlet. The first outlet is in communication with the first compartment, and the second outlet is in communication with the second compartment. A fan is positioned within the housing and is configured to direct the cooled air from the inlet toward the first and second outlets. A damper assembly is configured to selectively obstruct one of the first outlet and the second outlet.

19 Claims, 21 Drawing Sheets

(56) References Cited

U.S. PATENT DOCUMENTS

| | | | | |
|---|---|---|---|---|
| 10,571,183 | B2 | 2/2020 | Cheng et al. | |
| 2007/0107452 | A1 | 5/2007 | Kim et al. | |
| 2009/0113924 | A1* | 5/2009 | Bae | F25D 17/065 29/890.035 |
| 2015/0121919 | A1 | 5/2015 | Lee et al. | |
| 2017/0336127 | A1 | 11/2017 | Fei et al. | |
| 2018/0173254 | A1 | 6/2018 | Li et al. | |
| 2018/0180345 | A1 | 6/2018 | Zhu et al. | |
| 2018/0245836 | A1 | 8/2018 | Zhang et al. | |
| 2018/0274840 | A1 | 9/2018 | Fei et al. | |
| 2019/0368800 | A1 | 12/2019 | Cheng et al. | |

FOREIGN PATENT DOCUMENTS

| | | | |
|---|---|---|---|
| DE | 3144899 | | 5/1983 |
| EP | 0727031 | B1 | 1/2001 |
| EP | 1788327 | A2 | 5/2007 |
| EP | 3428557 | | 1/2019 |
| KR | 20140004420 | | 1/2014 |
| WO | 2016206215 | | 12/2016 |
| WO | 2016206217 | | 12/2016 |
| WO | 2016206218 | | 12/2016 |
| WO | 2016206219 | | 12/2016 |
| WO | 2017152538 | | 9/2017 |
| WO | 2017211073 | | 12/2017 |
| WO | 2018040448 | | 3/2018 |
| WO | 2018188644 | | 10/2018 |
| WO | 2018188645 | | 10/2018 |
| WO | 2018188647 | | 10/2018 |
| WO | 2019001475 | | 1/2019 |
| WO | 2019001491 | | 1/2019 |
| WO | 2019001494 | | 1/2019 |
| WO | 2019001495 | | 1/2019 |
| WO | 2019001501 | | 1/2019 |
| WO | 2019001502 | | 1/2019 |
| WO | 2019001503 | | 1/2019 |
| WO | 2019001504 | | 1/2019 |
| WO | 2019052512 | | 3/2019 |
| WO | 2019052513 | | 3/2019 |
| WO | 2019105424 | | 6/2019 |
| WO | 2019114491 | | 6/2019 |
| WO | 2019114492 | | 6/2019 |
| WO | 2020000929 | | 1/2020 |

* cited by examiner

COOLING ASSEMBLY FOR REFRIGERATOR APPLIANCE

CROSS-REFERENCE TO RELATED APPLICATION

This application claims priority to and the benefit under 35 U.S.C. § 119(e) of U.S. Provisional Application No. 62/966,643, filed on Jan. 28, 2020, entitled COOLING ASSEMBLY FOR REFRIGERATOR APPLIANCE, the disclosure of which is hereby incorporated herein by reference in its entirety.

FIELD OF DISCLOSURE

The present disclosure generally relates to a cooling assembly for a refrigerator appliance, and more specifically, to a cooling assembly with a fan assembly for selectively directing air into a compartment of a refrigerator appliance.

BACKGROUND

A refrigerator appliance traditionally defines compartments for storing food at various temperatures. Where the appliance includes more than one compartment, a single cooling assembly may be used to cool the compartments. In order to provide flexibility in the use of various compartments, it may be desired to provide varying amounts of cooled air to each of the various compartments.

SUMMARY OF THE DISCLOSURE

According to one aspect of the present disclosure, a cooling assembly for a refrigerator appliance includes a housing that defines an inlet, a first outlet, and a second outlet. The first outlet is defined opposite the second outlet. A fan is positioned within the housing. The fan is configured to direct cooled air through the inlet and toward the first and second outlets. A damper assembly is configured to rotate between a first position and a second position. The damper assembly includes a rim coupled with a plurality of gear teeth. The plurality of gear teeth are positioned circumferentially about, and extend radially from, the rim. A sidewall extends from a surface of the rim and extends circumferentially about a portion of a circumference of the rim. An actuator includes an actuation gear configured to be engaged with the plurality of gear teeth. The actuation gear is configured to rotate the damper assembly between the first and second positions, including intermediate positions.

According to another aspect of the present disclosure, a cooling assembly for a refrigerator appliance includes a housing defining an inlet, a first outlet, and a second outlet. The first outlet is defined distal from the second outlet. A fan is positioned within the housing. The fan is configured to direct cooled air through the inlet and toward the first and second outlets. A damper assembly is configured to selectively obstruct one of the first and second outlets by rotating between a first position and a second position. The damper assembly includes a first damper that has a first plurality of gear teeth extending from a first rim and a first sidewall that extends from the first rim parallel with the first plurality of gear teeth. A second damper has a second plurality of gear teeth extending from a second rim and a second sidewall that extends from the second rim parallel with the second plurality of gear teeth. The first and second dampers are positioned such that the first plurality of gear teeth extend towards the second plurality of gear teeth.

According to yet another aspect of the present disclosure, a refrigerator appliance includes a cabinet that defines first and second compartments. A fan assembly is configured to direct cooled air from a cooling assembly into the first and second compartments. The fan assembly includes a housing that defines an inlet, a first outlet, and a second outlet. The first outlet is in communication with the first compartment, and the second outlet is in communication with the second compartment. A fan is positioned within the housing and is configured to direct the cooled air from the inlet toward the first and second outlets. A damper assembly is configured to obstruct, or selectively obstruct, one of the first outlet and the second outlet.

These and other features, advantages, and objects of the present disclosure will be further understood and appreciated by those skilled in the art by reference to the following specification, claims, and appended drawings.

Figure 1:
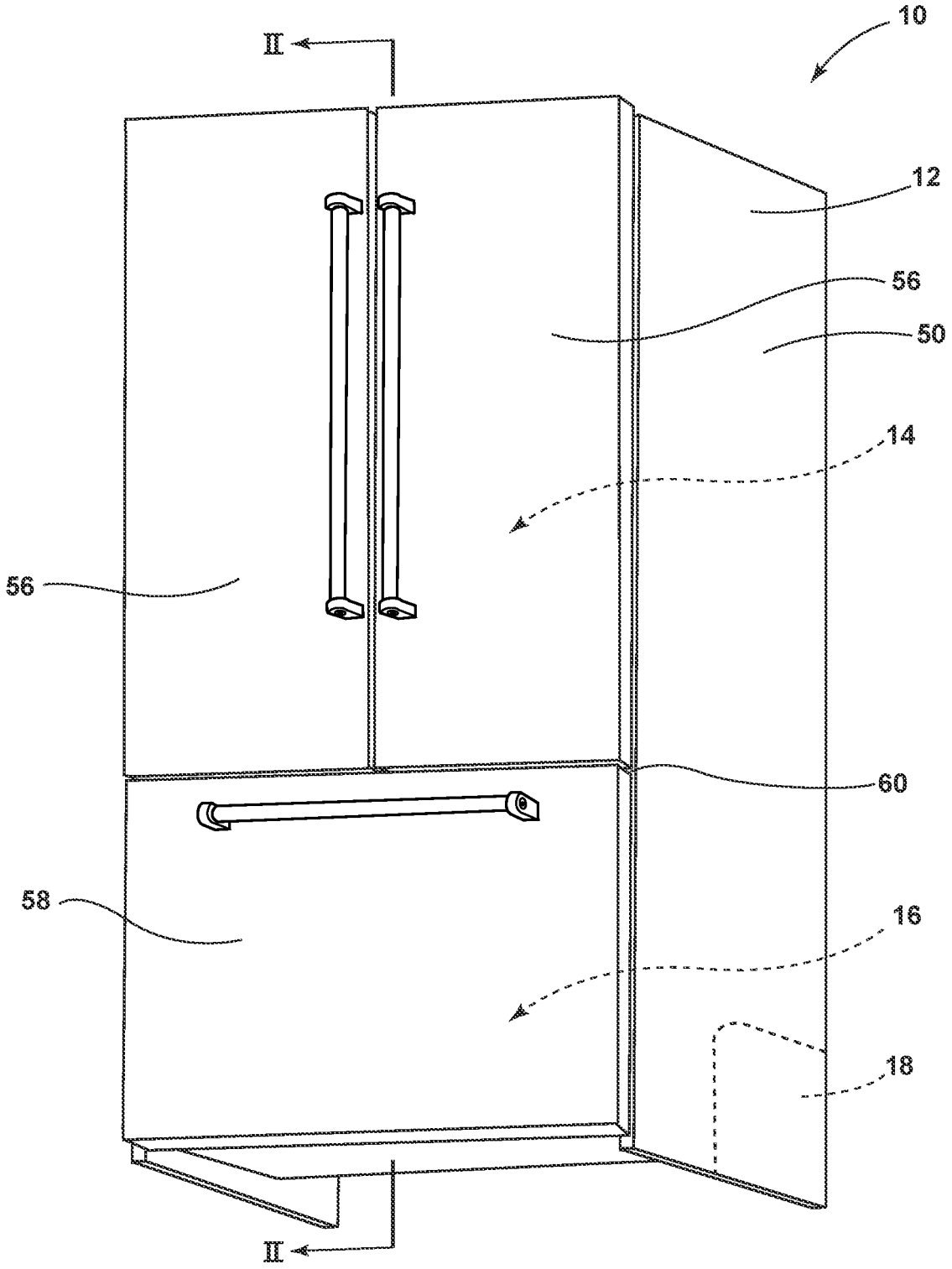
FIG. 1 is a front perspective view of a refrigerator appliance, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a fan assembly for a refrigerator appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-17, reference numeral 10 generally designates a refrigerator appliance that includes a cabinet 12. The cabinet 12 defines first and second compartments 14, 16. A cooling assembly 18 is configured to provide cooled air 20 to the first and second compartments 14, 16. A fan assembly 22, 22*a*, 22*b* is configured to direct the cooled air 20 into the first and second compartments 14, 16. The fan assembly 22, 22*a*, 22*b* includes a housing 24 that defines an inlet 26, a first outlet 28, and a second outlet 30. The first outlet 28 is in communication with the first compartment 14, and the second outlet 30 is in communication with the second compartment 16. A fan 32 is positioned within the housing 24 and is configured to direct the cooled air 20 through the inlet 26 and through the first and second outlets 28, 30. A damper assembly 34 is configured to selectively obstruct one of the first outlet 28 and the second outlet 30. The damper assembly 34 includes a sidewall 36 extending circumferentially about a rim 38. The rim 38 includes a plurality of gear teeth 40.

Figure 2:
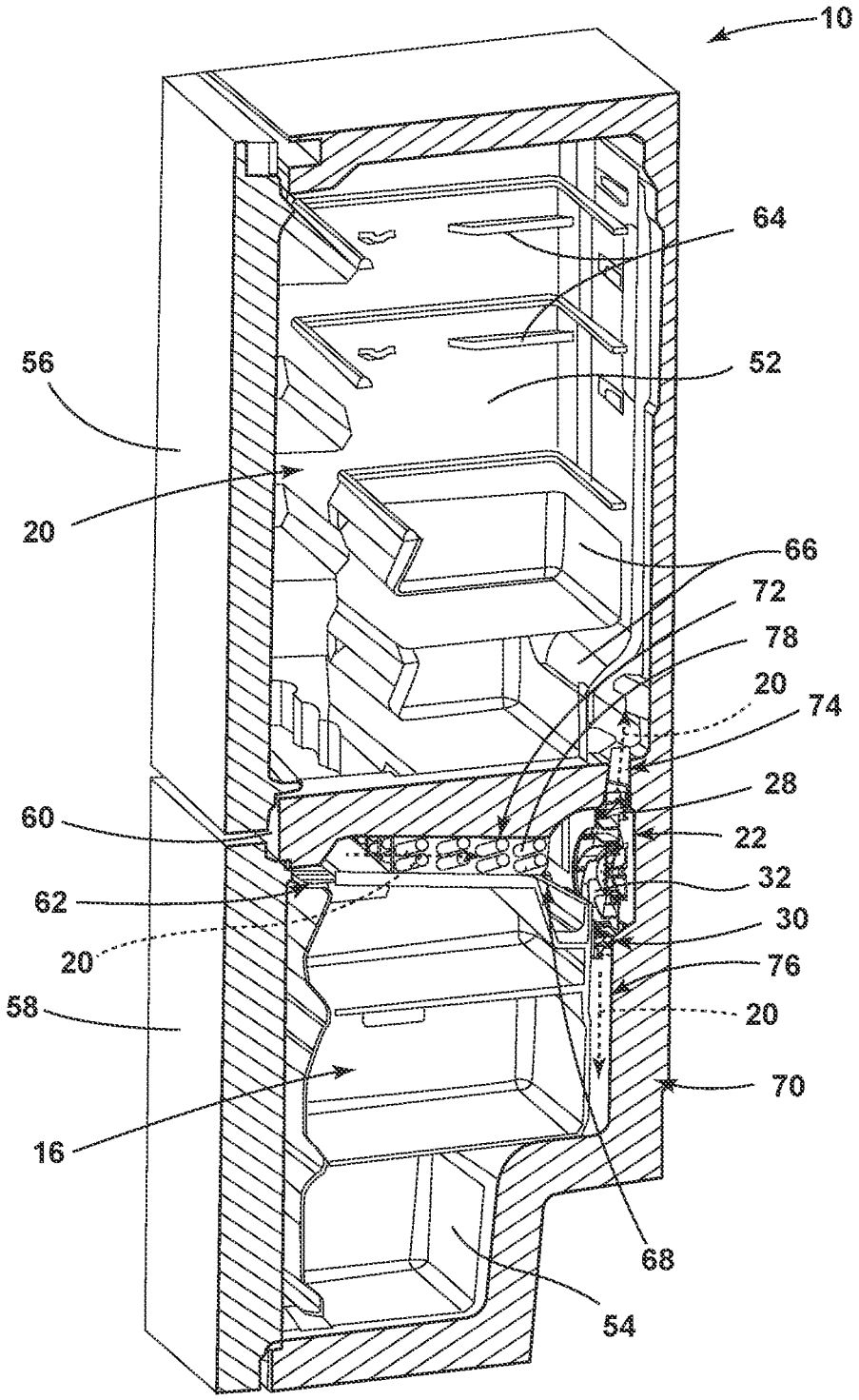
FIG. 2 is a cross-sectional view of the refrigerator appliance of FIG. 1 taken along line II-II and illustrating a cooling assembly.

Referring to FIGS. 1 and 2, the refrigerator appliance 10 includes a wrapper 50 forming an exterior of the refrigerator appliance 10, a first compartment liner 52, and a second compartment liner 54. One or more first doors 56 are configured to provide access to and seal the first compartment 14, and a second door 58 is configured to provide access to and selectively seal the second compartment 16. A mullion 60 may be disposed between the first compartment liner 52 and the second compartment liner 54. In various examples, the mullion 60 may be configured to at least partially house the cooling assembly 18.

Each of the first and second compartments 14, 16 may be configured to be used as one of a refrigeration compartment for storing fresh food items and a freezer compartment, and may be positioned in any arrangement. For example, as illustrated, the first and second compartments 14, 16 may be arranged in a bottom mount configuration with the first compartment 14 positioned above the second compartment 16 and configured to act as a refrigeration compartment while the second compartment 16 acts as a freezer compartment. However, it will be understood that any configuration of first and second compartments 14, 16 may be used, including but not limited to, side-by-side refrigerator/freezers, top-mount freezers, etc. Accordingly, embodiments of the present disclosure are therefore not intended to be limited to any particular type and/or configuration of the refrigerator appliance 10.

Referring now to FIG. 2, a cross-section of the refrigerator appliance 10 is illustrated to reveal the first compartment 14 and the second compartment 16, which are separated by the mullion 60. As illustrated, a number of shelves 64 and/or storage bins 66 may be disposed in the first compartment 14. It is contemplated that the shelves 64 and bins 66 may also be disposed in the second compartment 16 without departing from the scope of the present disclosure. It is further contemplated that the shelves 64 and bins 66 may be adjustable based on the configuration of the first and second compartments 14, 16.

Referring again to FIGS. 1 and 2, the wrapper 50, the first compartment liner 52, and the second compartment liner 54 are in a spaced-apart configuration forming the first compartment 14 and the second compartment 16. In the spaced-apart configuration, the wrapper 50 and the first and second compartment liners 52, 54 define a space 70 therebetween configured to house insulation.

The appliance 10 further includes the cooling assembly 18 configured to generate cooled air 20 to chill the first and second compartments 14, 16. The cooling assembly 18 may be configured to maintain the first and second compartments 14, 16 of the appliance 10 at a predetermined temperature. The cooling assembly 18 may include at least an evaporator 78, a compressor 80, a condenser 82, and a multi-directional valve 86. These and any other components of the cooling assembly 18 may be arranged and interconnected in a standard configuration for such components.

Figure 3:
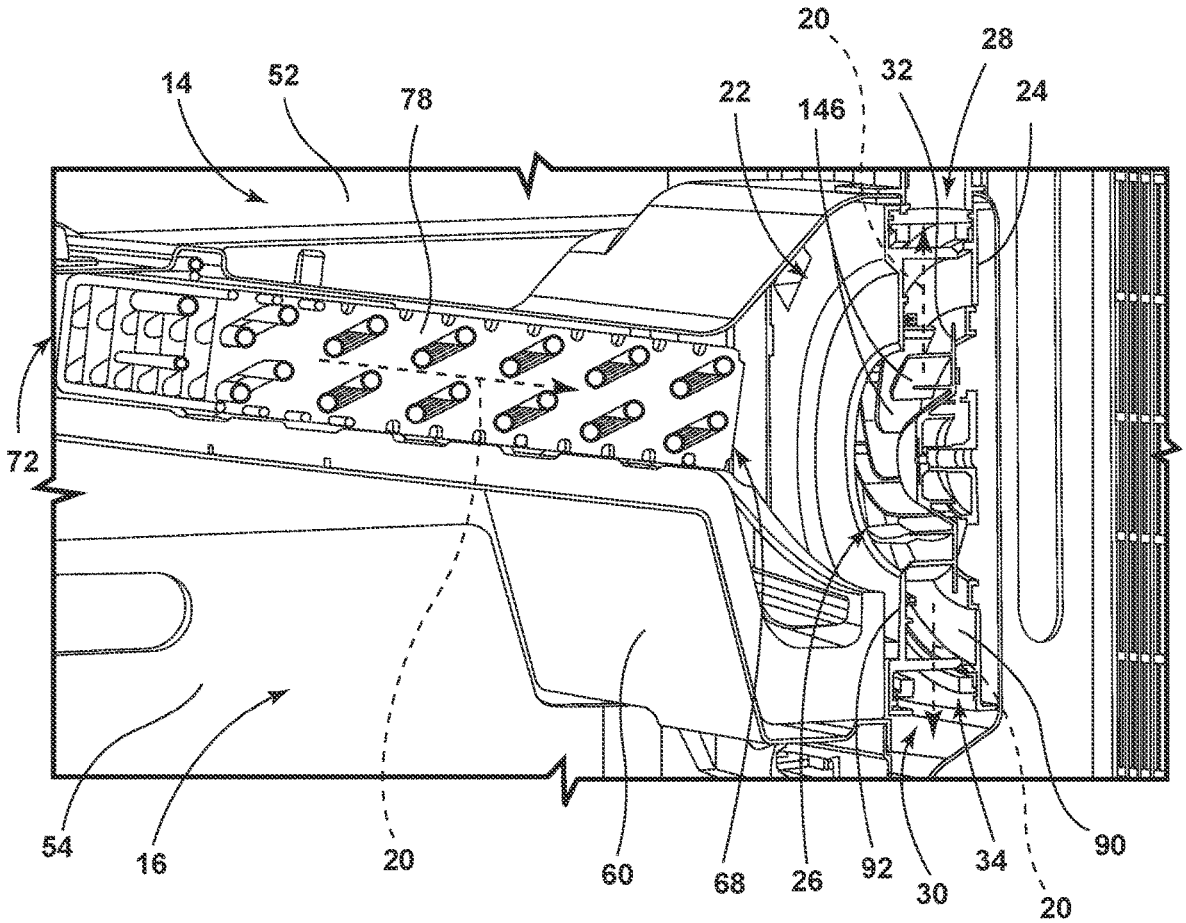
FIG. 3 is an enlarged view of the cooling assembly of FIG. 2 including a fan assembly.

Referring now to FIGS. 2 and 3, the mullion 60 may define a channel 72 between the first and second compartment liners 52, 54. The channel 72 may be in communication with an inlet 62 defined by the second compartment liner 54 and may be configured to house the evaporator 78 of the cooling assembly 18. The fan assembly 22 is positioned proximate an outlet 68 of the channel 72. When actuated, the fan assembly 22 may be configured to pull air across the evaporator 78 to create cooled air 20. The cooled air 20 is pulled or directed into the housing 24 of the fan assembly 22 through the inlet 26 of the housing 24. The fan 32 directs the cooled air 20 through one or both of the first and second outlets 28, 30 of the housing 24 by the fan 32 and into one or both of the first and second compartments 14, 16.

The fan 32 is positioned within the housing 24 of the fan assembly 22, and the housing 24 is operably coupled with first and second connector passages 74, 76 to guide the cooled air 20 from the first and second outlets 28, 30 of the housing 24 and into the first and second compartments 14, 16. The fan 32 is configured to pull the cooled air 20 from the cooling assembly 18 through the channel 72 and to direct the cooled air 20 into one or both of the first connector passage 74 that is in communication with the first compartment 14 and a second connector passage 76 that is in communication with the second compartment 16. As illustrated, the fan assembly 22 and the connector passages 74, 76 are positioned rearward of the first and second compartment liners 52, 54. However, it is contemplated that the fan assembly 22 and the connector passages 74, 76 may be positioned in any location of the refrigerator appliance 10 to allow the fan assembly 22 to direct the cooled air 20 from the channel 72 and into the first and second compartments 14, 16, as needed. It is further contemplated that the fan assembly 22 may be positioned to provide the cooled air 20 directly to the first and second compartments 14, 16 without the use of the connector passages 74, 76 without departing from the scope of the present disclosure.

Figure 4:
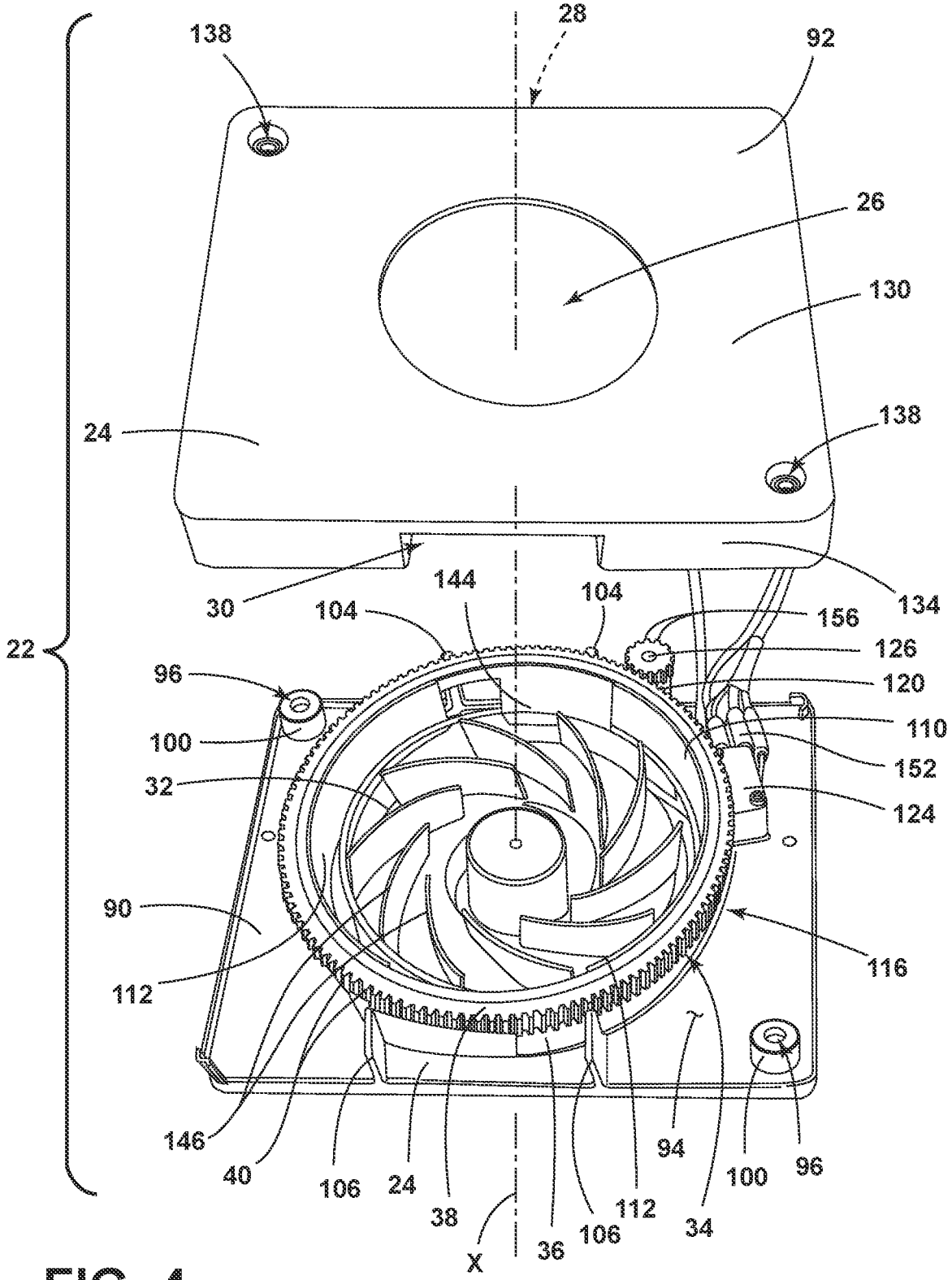
FIG. 4 is a top perspective view of a fan assembly with a top portion of a housing removed, according to various examples.
Figure 5A:
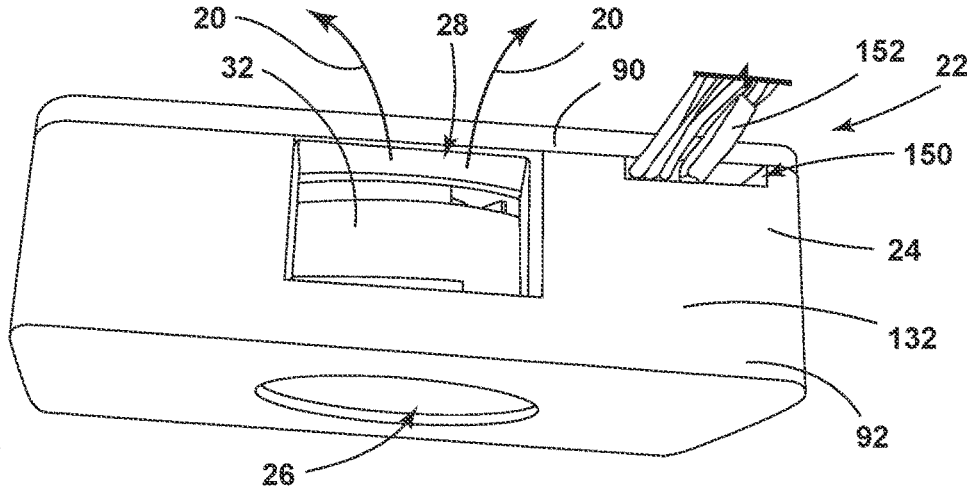
FIG. 5A is a first side perspective view of the fan assembly of FIG. 4 with a damper positioned so that a first outlet is unobstructed.
Figure 5B:
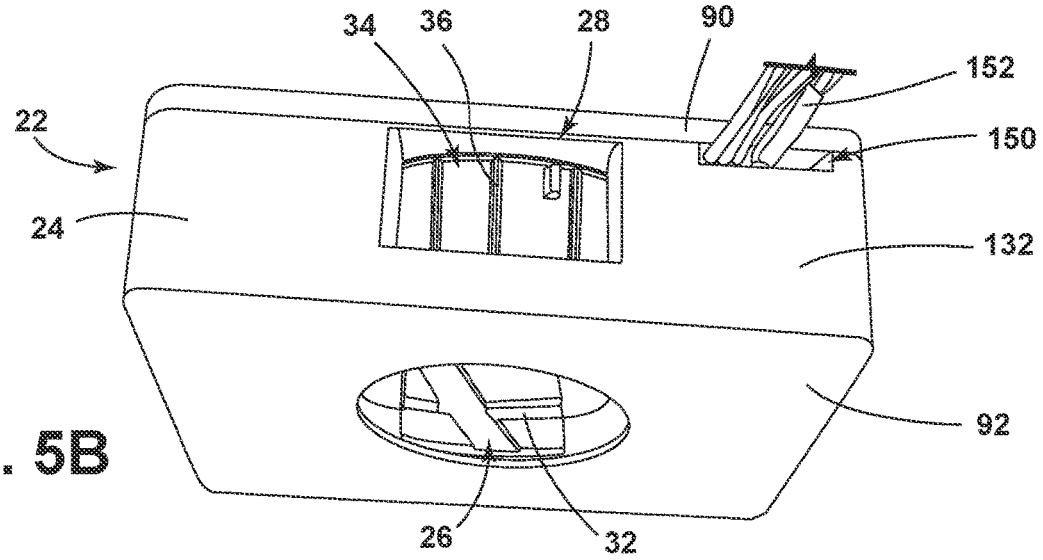
FIG. 5B is a first side perspective view of the fan assembly of FIG. 4 with a damper positioned so that a first outlet is obstructed.
Figure 5C:
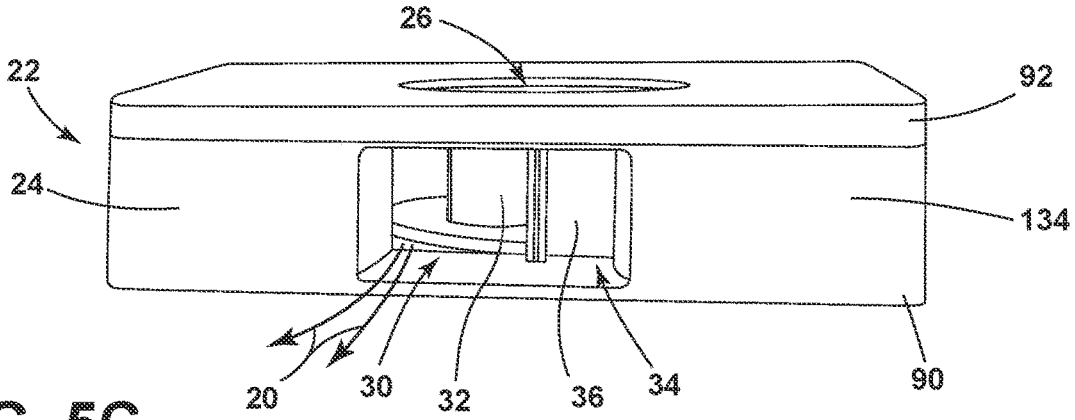
FIG. 5C is a second side perspective view of the fan assembly of FIG. 4 with a damper positioned so that a second outlet is partially obstructed.
Figure 6:
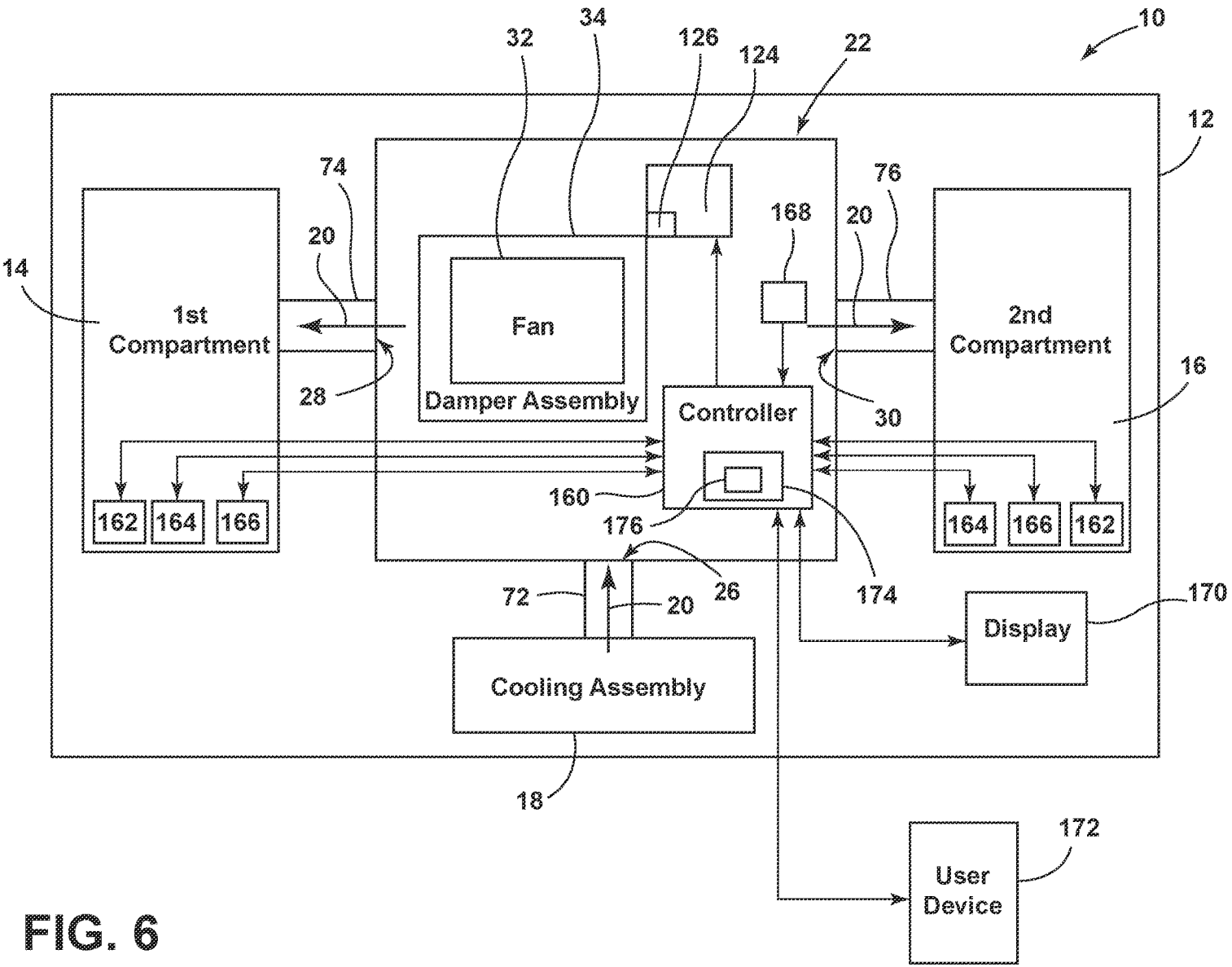
FIG. 6 is a schematic control diagram of the fan assembly of FIG. 4.

Referring now to FIGS. 4-5C, the fan assembly 22 is illustrated according to an exemplary embodiment. As introduced above, the fan assembly 22 includes the housing 24 configured to house the fan 32 and the damper assembly 34. The housing 24 defines the inlet 26, the first outlet 28, and the second outlet 30. As illustrated, the housing 24 may have a generally rectilinear shape. However, it will be understood that the housing 24 may alternatively have a circular, oblong, triangular shape, or may have any other cross-sectional shape that can be used to house the fan assembly 22 and the damper assembly 34 to direct cooled air 20 to the compartments 14, 16.

As illustrated in FIG. 4, the housing 24 includes a base portion 90 and a cover portion 92. The base portion 90 is configured as a plate that has an inner surface 94 and that defines one or more receiving wells 96. In various examples, the one or more receiving wells 96 may be defined flush with the inner surface 94 of the base portion 90. In other examples, the one or more receiving wells 96 may be defined by raised portions 100 extending from the inner surface 94. The raised portions 100 may be configured to at least partially space apart the base portion 90 and the cover portion 92 when the housing 24 is assembled.

The base portion 90 may include a first pair of offsets 104 and a second pair of offsets 106. The first and second pairs of offsets 104, 106 extend from the inner surface 94 of the base portion 90. When the base portion 90 is coupled with the cover portion 92, the first pair of offsets 104 is positioned to frame the first outlet 28 of the housing 24, and the second pair of offsets 106 is positioned to frame the second outlet 30 of the housing 24. The first and second pairs of offsets 104, 106 may be configured to at least partially space apart the base portion 90 and the cover portion 92 when the housing 24 is assembled. In various examples, the first and second pairs of offsets 104, 106 may also be configured to align the damper assembly 34 and/or the fan 32 within the housing 24.

A damper guide 110 extends from the inner surface 94 of the base portion 90. The damper guide 110 is configured to align the fan 32 and the damper assembly 34 within the housing 24. The damper guide 110 includes one or more arcuate portions 112 positioned circumferentially about a center axis X of the housing 24. The one or more arcuate portions 112 may be spaced apart so that the arcuate portions 112 define gaps that are generally aligned with the first and second offsets 104, 106. The damper guide 110 may further include a track 116 defined by the inner surface 94 of the base portion 90 and defined to extend circumferentially about an exterior of the arcuate portions 112. The track 116 of the damper guide 110 is also defined to be concentrically and axially aligned with the central axis X of the housing 24.

The base portion 90 may further include a mount 120 configured to support one or both of an actuator 124 and an actuation gear 126. For example, the mount 120 may be configured to support the actuator 124 which in turn supports the actuation gear 126. Alternatively, the mount 120 may be configured to support the actuation gear 126, and the actuator 124 may be coupled with the inner surface 94 of the base portion 90. The actuator 124 and the actuation gear 126 are positioned proximate the damper guide 110, and the actuation gear 126 is configured to engage with the damper assembly 34, as discussed elsewhere herein.

Referring still to FIG. 4, the cover portion 92 of the housing 24 includes a central wall 130 sized to complement the size and shape of the base portion 90. The cover portion 92 further includes at least first and second sidewalls 132, 134 extending perpendicularly from opposing edges of the central wall 130. The first sidewall 132 defines the first outlet 28, and the second sidewall 134 defines the second outlet 30 such that the second outlet 30 is typically defined opposite the first outlet 28. In various examples, the first and second outlets 28, 30 may be the same size and shape. In other examples, the first and second outlets 28, 30 may differ in size and shape. For example, the first outlet 28 may be larger than the second outlet 30, or the second outlet 30 may be larger than the first outlet 28. As illustrated, the first and second outlets 28, 30 may be substantially rectangular. However, it is contemplated that the first and second outlets 28, 30 may have any shape without departing from the scope of the present disclosure. When the cover portion 92 of the housing 24 is coupled with the base portion 90, the first outlet 28 is aligned with the first offsets 104 and the second outlet 30 is aligned with the second offsets 106.

The central wall 130 of the cover portion 92 defines one or more through-holes 138. The one or more through-holes 138 are defined to align the one or more receiving wells 96 defined by the base portion 90 when the housing 24 is assembled. For example, the one or more through-holes 138 and the one or more receiving wells 96 may be positioned proximate corners of the base portion 90 and the cover portion 92. Further, the one or more through-holes 138 may be defined by extended portions of the central wall 130 configured to abut the raised portions 100 of the base portion 90 to space apart the base portion 90 and the cover portion 92 when the housing 24 is assembled.

The central wall 130 of the cover portion 92 defines the inlet 26 of the housing 24. The inlet 26 may be substantially circular and is axially aligned with the central axis X of the housing 24 and the fan 32. The inlet 26 is defined to be the same size or smaller than the fan 32 and is sized to allow the fan 32 to pull the cooled air 20 (FIGS. 2 and 3) through the inlet 26 into the housing 24. The central axis X of the housing 24 passes through the inlet 26 and is typically configured to be perpendicular to a centerline extending through one or both of the first and second outlets 28, 30.

As illustrated in FIG. 4-5C, the fan 32 is rotatably coupled with the base portion 90 and is positioned within the damper guide 110 of the housing 24 so as to rotate within the damper guide 110 about the central axis X of the housing 24. The fan 32 includes a fan rim 144, and a plurality of fins 146 extend outward from a center of the fan 32 toward the fan rim 144 in an arcuate and outwardly radial pattern, sometimes referred to as a "sunburst" pattern. The fan 32 is configured to pull or otherwise direct the cooled air 20 from the inlet 26 of the housing 24 and direct the air 20 through the at least one of first and second outlets 28, 30 of the housing 24. It will be understood that the fan 32 may be conventionally operated by a motor and/or related electronics (e.g., a fan controller, a timer, etc.) without departing from the scope of the present disclosure.

The damper assembly 34 extends around the circumference of the fan 32 and is configured to rotate to selectively obstruct one or both of the first and second outlets 28, 30 of the housing 24. The damper assembly 34 is also configured to rotate about the damper guide 110. As illustrated, the damper assembly 34 may be positioned exterior of the damper guide 110. However, it is contemplated that the damper assembly 34 may be positioned at least partially interior of the damper guide 110 without departing from the scope of the present disclosure. The damper assembly 34 includes a rim 38 that defines a plurality of gear teeth 40 that extend radially from the rim 38. In various examples, the plurality of gear teeth 40 may be integrally formed with the rim 38. In other examples, the plurality of gear teeth 40 may be integrally formed with a ring configured to be positioned about and/or coupled to the rim 38. The plurality of gear teeth 40 may be defined circumferentially along at least part of the circumference of the rim 38, and, in various examples, may be positioned along the entire circumference of the rim 38.

As exemplified in FIGS. 4-5C, a sidewall 36 extends downward from the rim 38 and is slidably engaged with at least part of the damper guide 110. For example, the sidewall 36 may be positioned in a close sliding relationship with one or both of the arcuate portions 112 of the damper guide 110. The sidewall 36 extends circumferentially about a portion of the rim 38 of the damper assembly 34. For example, the sidewall 36 may extend along a quart of the circumference of the rim 38, along half the circumference of the rim 38, along three-quarters of the circumference of the rim 38, or any other fraction of the circumference of the rim 38 so that the sidewall 36 is at least large enough to cover one of the first and second outlets 28, 30.

Referring again to FIG. 4, the actuator 124 is coupled with the base portion 90 of the housing 24 and may be any actuator 124 configured to rotate the actuation gear 126 (e.g., a motor). In various examples, a portion of the housing 24 may define an opening 150 configured to receive a plurality of electrical connectors 152 operably coupled with the actuator 124. The actuation gear 126 is rotatably coupled with the actuator 124 and includes a plurality of actuation teeth 156 that are configured to be engaged with the plurality of gear teeth 40 of the damper assembly 34. Rotation of the actuation gear 126 by the actuator 124 rotates the damper assembly 34 between first and second positions (FIGS. 5A-5C). The actuation gear 126 is configured to be rotated in both a clockwise and counterclockwise direction to provide rotation of the damper assembly 34 in both a clockwise and counterclockwise direction between the first and second positions.

Referring again to FIGS. 4-5C, the actuation gear 126 is configured to rotate the damper assembly 34 between the first position (FIG. 5A), the second position (FIG. 5B), and any one of a plurality of intermediate positions (FIG. 5C). When the damper assembly 34 is in the first position, the sidewall 36 is positioned to obstruct the first outlet 28, and when the damper assembly 34 is in the second position, the sidewall 36 is positioned to obstruct the second outlet 30. When the damper assembly 34 is in one of the first and second positions, the cooled air 20 is prevented from flowing through the respective outlet 28, 30 and cooled air 20 is prevented from moving into the respective compartment 14, 16 (FIGS. 2 and 3). This allows one of the compartments 14, 16 to receive all of the cooled air 20 generated by the cooling assembly 18 (FIGS. 2 and 3). When the damper assembly 34 is in one of the plurality of intermediate positions, the sidewall 36 partially obstructs one or both of the first and second outlets 28, 30. In various examples, the obstruction of the first and second outlets 28, 30 may be proportional so that, for example, when one-quarter of one of the outlets 28, 30 is obstructed, three-quarters of the other outlet 28, 30 is obstructed. A first volume of the cooled air 20 is directed through the first outlet 28 and into the first compartment 14 and a second volume of the cooled air 20 is directed through the second outlet 30 and into the second compartment 16. In this configuration, the damper assembly 34 can be positioned to allow for a predictable and repeatable apportionment of the cooled air 20 between the first and second outlets 28, 30 and, in turn, the first and second compartments 14, 16. Alternatively, the damper assembly 34 may be configured to provide a non-proportional obstruction of each of the first and second outlets 28, 30.

Referring now to FIGS. 2-6, a controller 160 is operably coupled with the actuator 124. The controller 160 is configured to actuate the actuator 124 in response to input from a sensor (e.g., a temperature sensor 164, a door sensor 166, or any other sensor). The sensors 164, 166 may correspond with either of the first compartment 14 or the second compartment 16. In various examples, each of the first and second compartments 14, 16 may include one or more separate sensors. Alternatively, the controller 160 may be configured to actuate the actuator 124 based on a timed sequence regulated by a timer 168 such that the actuator 124 rotates the damper assembly 34 at predetermined time intervals. The controller 160 may further be actuated in response to user input from a display 170, or a user device 172 (e.g., an electronic device or a remote control). The user input may be configured to select one of the first position, the second position, or any one of a plurality of intermediate positions of the damper assembly 34.

The controller 160 includes memory 174 configured to store instructions 176 to actuate the actuator 124 to rotate the damper assembly 34 based on the received input. For example, the controller 160 may actuate the actuator 124 to rotate the actuation gear 126, and subsequently the damper assembly 34, to provide obstruction of the first and second outlets 28, 30 based on a selected or predetermined temperature of the first compartment 14 as chosen by a user and as monitored by a temperature sensor 164 within the first compartment 14. When a user selects a first temperature for the first compartment 14, the controller 160 actuates the actuator 124 to rotate the damper assembly 34 to ensure that the appropriate first volume of air-flow 20 is provided to the first compartment 14. The controller 160 may also receive input from the sensors 164, 166 to determine if the position of the damper assembly 34 should be changed to provide a larger or smaller volume of the air-flow 20 into the first compartment 14 based on the temperature of the first compartment 14 and/or the position of the door 56 to the first compartment 14. For example, when the door 56 is open, or shortly after the door 56 is closed, the controller 160 may actuate the actuator 124 to rotate the damper assembly 34 to allow a larger volume of air-flow into the first compartment 14.

Figure 7:
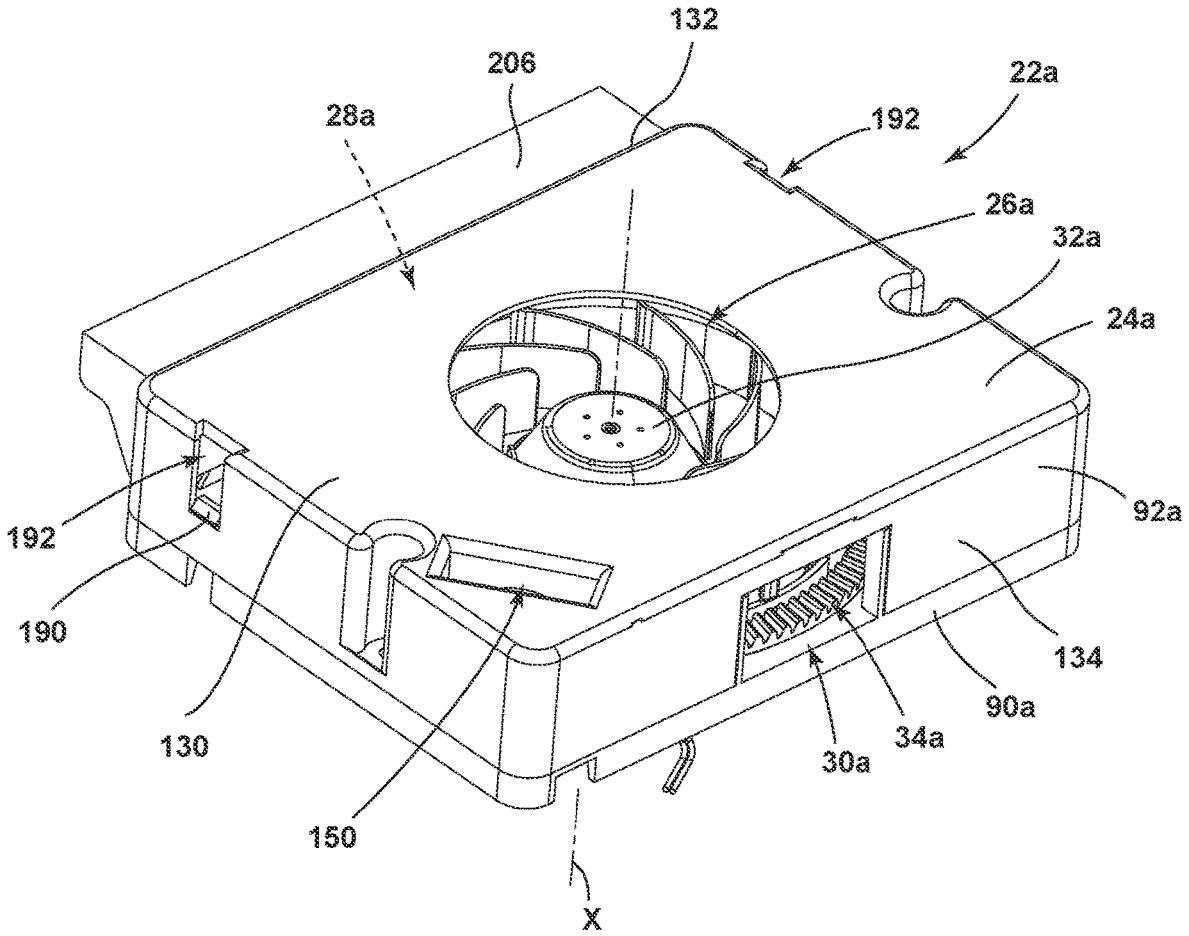
FIG. 7 is a top perspective view of a fan assembly, according to various examples.

Referring now to FIG. 7-11B, the fan assembly 22*a* is illustrated according to another exemplary embodiment. Where features of the fan assembly 22*a* are similar to the features of the fan assembly 22*a* illustrated in FIGS. 4-6, the same or similar numbers have been used. As illustrated in FIG. 7, the fan assembly 22*a* includes the housing 24*a* configured to enclose the fan 32 and the damper assembly 34*a*. The housing 24*a* includes the base portion 90*a* coupled with the cover portion 92*a*.

The base portion 90*a* includes a plurality of clips 190 extending from the base portion 90*a*. The plurality of clips 190 are configured to engage with corresponding receptacles 192 defined by the cover portion 92*a*. When the plurality of clips 190 are received by the corresponding receptacles 192, the base portion 90*a* is coupled with the cover portion 92*a*. The cover portion 92*a* may further define the opening 150 for receiving electrical connectors 152 of the actuator 124. The opening 150 may be defined by the central wall 130 or one of the first and second sidewalls 132, 134.

The base portion 90*a* further includes the first and second pairs of offsets 104, 106 configured to frame the first and second outlets 28*a*, 30*a*, respectively. In various examples, the second offsets 106 may be integrally formed with a first portion 196 of a damper guide 198. The first portion 196 of the damper guide 198 includes opposing arcs 200 positioned to at least partially define a semi-circle. A second portion 202 of the damper guide 198 may be positioned interior of the first portion 196 of the damper guide 198 so that the first and second portions 196, 202 of the damper guide 198 surround a circular track 204, while leaving gaps that partially define the first and second outlets 28*a*, 30*a*. The circular track 204 extends circumferentially about an opening 208 that may be configured to at least partially receive the fan 32*a*. The track 204 is defined by the base portion 90*a* of the housing 24*a* and is at least partially positioned between the first portion 196 and the second portion 202 of the damper guide 198. The track 204 is configured to at least partially receive and/or retain the damper assembly 34*a*.

The cover portion 92 of the housing 24*a* includes the central wall 130 defining the inlet 26*a*. As discussed elsewhere herein, the inlet 26*a* is substantially circular and is axially aligned with the center axis X of the housing 24*a* and the fan 32*a*. The cover portion 92*a* may further include an extension 206 coupled with the first sidewall 132 of the cover portion 92*a*. The extension 206 is configured to extend at least partially along the perimeter of the first outlet 28*a*. It will be understood that only the first outlet 28*a* may be surrounded by an extension 206 or that each of the outlets 28*a*, 30*a* may be surrounded by a corresponding extension 206. It is also contemplated that neither of the outlets 28*a*, 30*a* may be surrounded by an extension 206.

As discussed previously, the first sidewall 132 of the cover portion 92*a* defines the first outlet 28*a*, and the second sidewall 134 defines the second outlet 30*a*. As illustrated, the first outlet 28*a* may be larger than the second outlet 30*a*. Alternatively, the first and second outlets 28*a*, 30*a* may be the same size, or the second outlet 30*a* may be larger than the first outlet 28*a*. The first portion 196 of the damper guide 198 is aligned with the first outlet 28*a*, and the second portion 202 of the damper guide 198 is aligned with the second outlet 30*a*.

Figure 8:
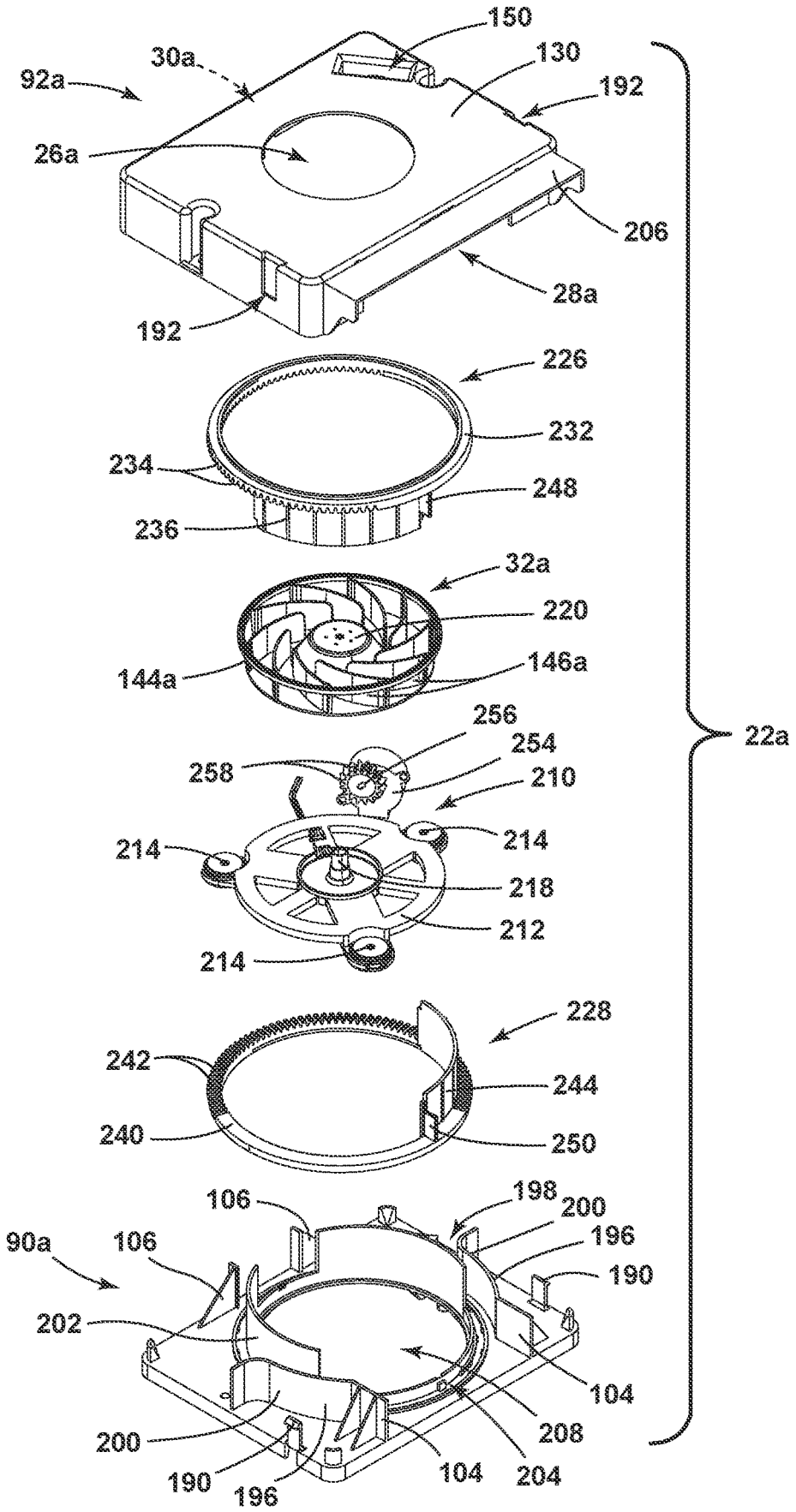
FIG. 8 is an exploded view of the fan assembly of FIG. 7.
Figure 9A:
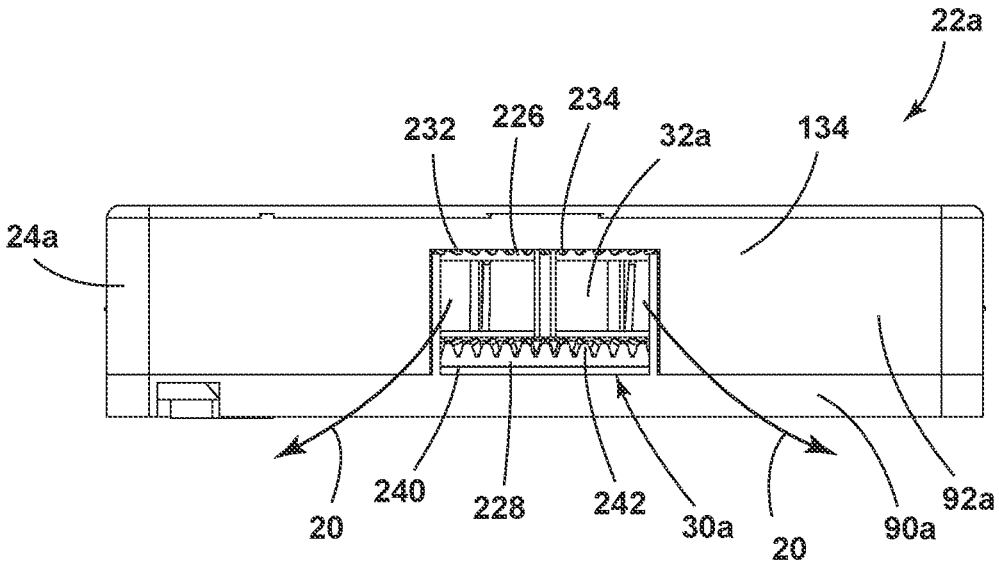
FIG. 9A is a first side elevation view of the fan assembly of FIG. 7 with a damper assembly in a first position.
Figure 9B:
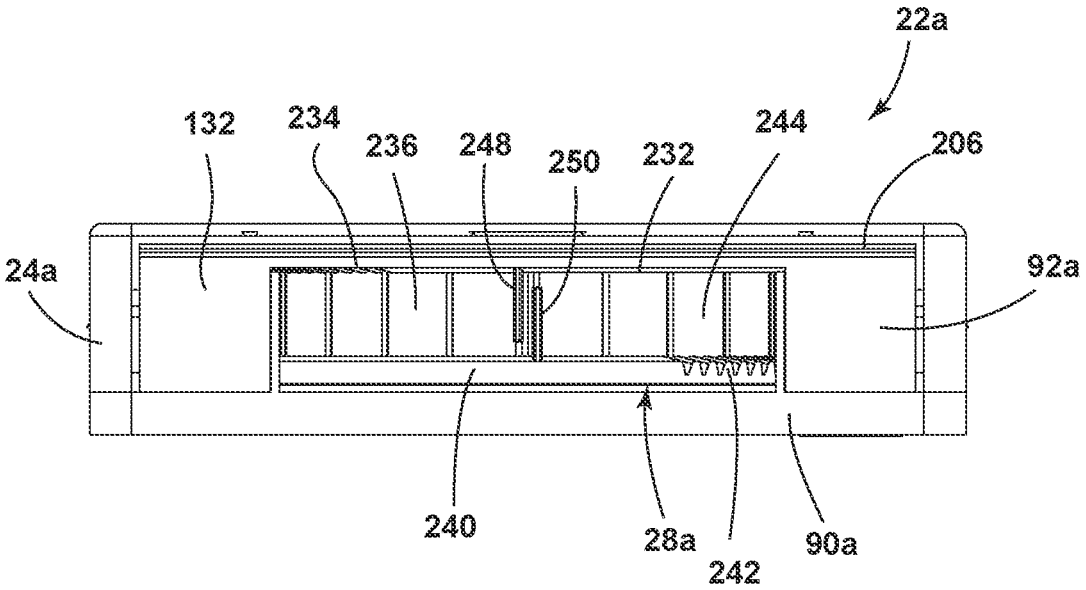
FIG. 9B is a second side elevation view of the fan assembly of FIG. 7 with a damper assembly in a first position.
Figure 10A:
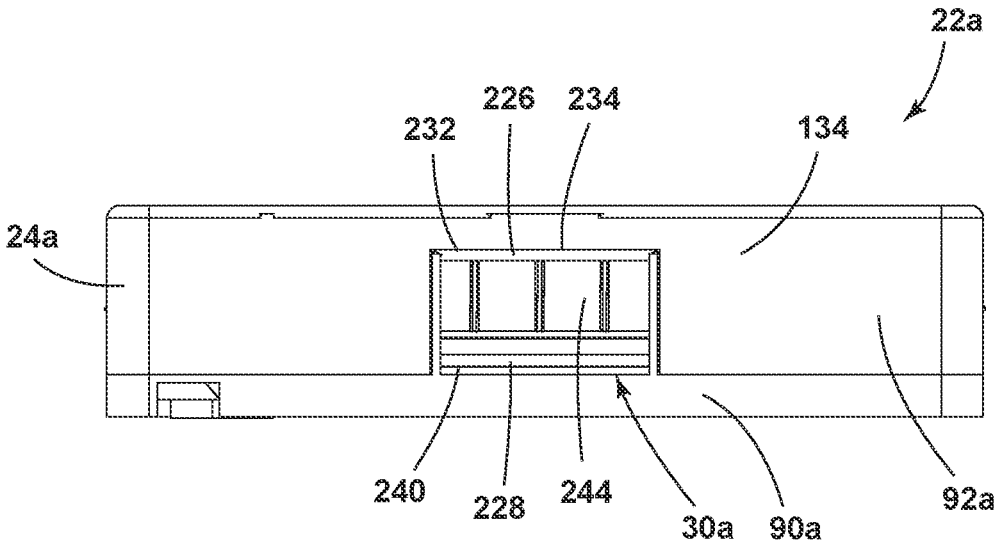
FIG. 10A is a first side elevation view of the fan assembly of FIG. 7 with a damper assembly in a second position.
Figure 10B:
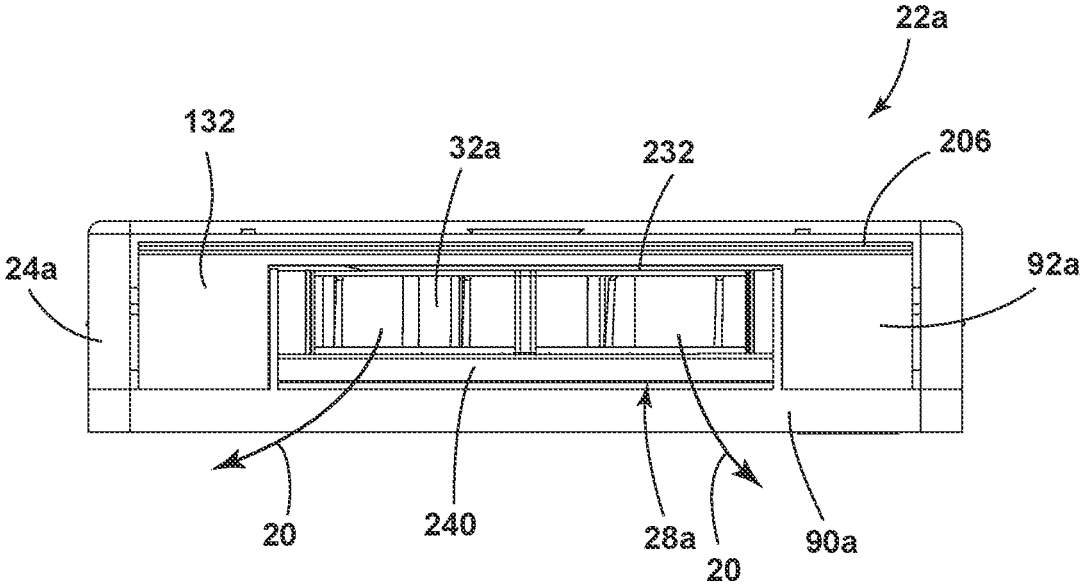
FIG. 10B is a second side elevation view of the fan assembly of FIG. 7 with a damper assembly in a second position.

Referring now to FIG. 8, the fan 32*a* is configured to be rotatably coupled with a fan support 210. The fan support 210 includes a substantially circular body 212 having a plurality of protrusions 214 configured to be coupled with the base portion 90*a* of the housing 24*a*. The fan support 210 is aligned with the opening 208 of the base portion 90*a* of the housing 24*a* so that the body 212 is at least partially received by the opening 208. A rotating shaft 218 extends from the body 212 and is aligned with the center axis X of the housing 24*a* when the fan support 210 is coupled with the base portion 90*a*.

The fan 32*a* includes a central portion 220 configured to receive the rotating shaft 218 such that the fan 32*a* is rotatable about the rotating shaft 218. The fan 32*a* further includes a plurality of fins 146*a* that extend outwardly from the central portion 220. The plurality of fins 146*a* may be positioned in a sunburst pattern and may extend from the central portion 220 to a fan rim 144*a*. For example, the fan 32*a* may be configured as a centrifugal fan. It will be understood that the fan 32*a* may be conventionally operated by a motor and/or related electronics (e.g., a fan controller, a timer, etc.) without departing from the scope of the present disclosure.

As illustrated in FIG. 8, the damper assembly 34*a* may include a first damper 226 and a second damper 228 positioned to surround the fan 32*a*. The first damper 226 includes a first rim 232 sized to extend about the circumference of the opening 208 of the base portion 90*a*. The first rim 232 includes a first plurality of gear teeth 234 extending at least partially about the circumference of the first rim 232. The first plurality of gear teeth 234 are positioned to extend from the first rim 232 in a direction that is transverse to a lower surface of the rim 232. In various examples, the first plurality of gear teeth 234 extend along the full circumference of the first rim 232. In other examples, the first plurality of gear teeth 234 extend along only part of the circumference of the first rim 232.

A first sidewall 236 extends from the first rim 232 in the same direction as, or substantially parallel to, the first plurality of gear teeth 234. The first sidewall 236 is configured to extend at least partially about the circumference of the first rim 232. For example, the first sidewall 236 may extend along a quarter of the circumference of the first rim 232, along a half of the circumference of the first rim 232, along three-quarters of the circumference of the first rim 232, or along any other portion of the circumference of the first rim 232 so that the sidewall 236 is large enough to obstruct at least one of the first and second outlets 28*a*, 30*a*. The first sidewall 236 is configured to at least be partially received by the track 204 defined by the base portion 90*a* of the housing 24*a* and slides along the track 204 as the first damper 226 rotates.

The second damper 228 includes a second rim 240. The second rim 240 is sized to extend about the circumference of the opening 208. The second rim 240 may be sized to be the same size as the first rim 232 and the second damper 228 may be positioned to align the second rim 240 with the first rim 232. A second plurality of gear teeth 242 extend from a surface of the second rim 240 in a direction opposite the direction of the first plurality of gear teeth 234 such that the first and second pluralities of gear teeth 234, 242 are spaced apart and extend toward one another. In various examples, the second plurality of gear teeth 242 extend along the full circumference of the second rim 240. In other examples, the second plurality of gear teeth 242 extend along only part of the circumference of the second rim 240. In various examples, the second plurality of gear teeth 242 extends circumferentially about the second rim 240 such that, when the damper assembly 34 is positioned within the fan housing 22, the second plurality of gear teeth 242 at least partially aligns with the first plurality of gear teeth 234.

A second sidewall 244 extends from the second rim 240 in the same direction as, or substantially concentric with, the second plurality of gear teeth 242. The second sidewall 244 may extend along at least part of the circumference of the second rim 240. For example, the second sidewall 244 may extend along a quarter of the circumference of the second rim 240, along a half of the circumference of the second rim 240, along three-quarters of the circumference of the second rim 240, or along any other portion of the circumference of the second rim 240 so that the first sidewall 236 and the second sidewall 244 together are at least large enough to cover each of the first and second outlets 28*a*, 30*a*.

The second rim 240 of the second damper 228 is sized to be at least partially received by the track 204 defined by the base portion 90*a* of the housing 24*a*. The second rim 240 is positioned within the track 204 such that the second plurality of gear teeth 242 extend upward from the track 204, and the second rim 240 is rotatable within the track 204.

A first stop 248 extends from an end of the first sidewall 236 along the width of the first rim 232. A second stop 250 extends from an end of the second sidewall 244 and extends along the width of the second rim 240. The first and second stops 248, 250 are configured to abut when the damper assembly 34*a* is in a first position that closes off the first outlet 28.

Referring still to FIG. 8, an actuator 254 may be operably coupled with one of the base portion 90*a* and the cover portion 92*a* of the housing 24*a*. Alternatively, the actuator 254 may be coupled with the fan support 210. The actuator 254 may be any kind of actuator (e.g., a motor) configured to rotate an actuation gear 256. Further, it will be understood that the actuator 254 may be one of multiple actuators configured to operate the damper assembly 34*a* without departing from the scope of the present disclosure.

The actuation gear 256 is operably coupled with the actuator 254 and is configured to be rotated by the actuator 254 in clockwise and counterclockwise directions. The actuation gear 256 includes a plurality of actuation teeth 258 extending about the circumference of the actuation gear 256. In certain aspects of the device, the actuation gear 256 is sized so that the actuation gear 256 has a diameter that is less than the spacing between the first and second dampers 226, 228 of the damper assembly 34*a*. In this embodiment, the actuator 254 and/or the actuation gear 256 are positioned such that the actuation gear 256 is positioned between the first and second rims 232, 240 of the damper assembly 34*a*. The plurality of actuation teeth 258 are positioned to engage, alternatively and selectively, with one of the first plurality of gear teeth 234 and the second plurality of gear teeth 242. In various examples, the actuation gear 256 may be adjustable between engagement with the first plurality of gear teeth 234 and the second plurality of gear teeth 242. When the actuation gear 256 is adjustable, the first and second dampers 226, 228 of the damper assembly 34 may be moved independently. In other aspects of the device, the actuation gear 256 may be sized to simultaneously engaged with both the first and second pluralities of gear teeth 234, 242 such that the first and second dampers 226, 228 are rotated together by rotation of the actuation gear 256. Where the first and second dampers 226, 228 are rotated together, the first and second dampers 226, 228 are rotated in opposite directions.

Figure 11A:
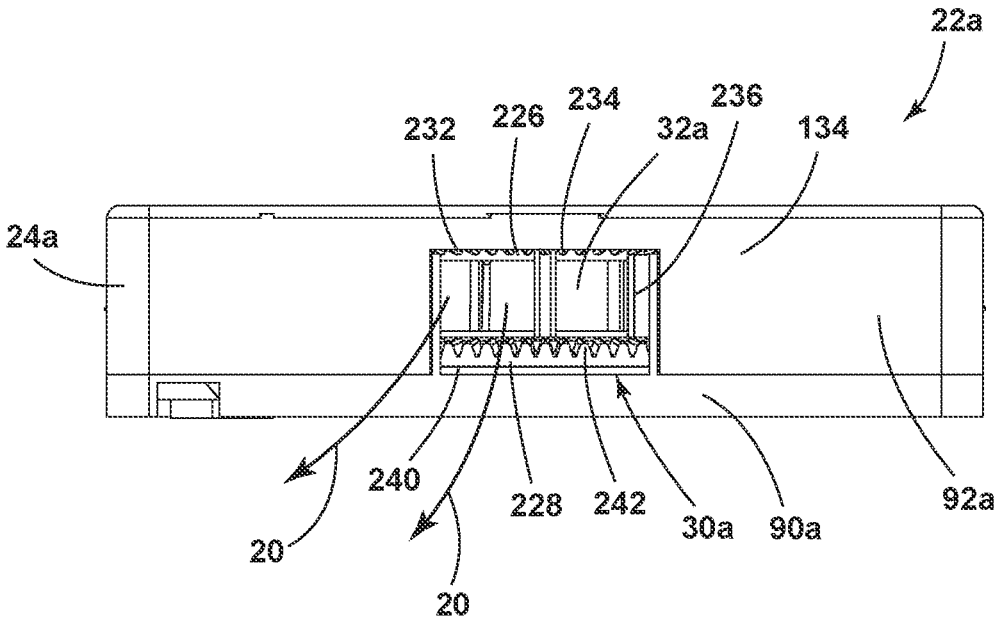
FIG. 11A is a first side elevation view of the fan assembly of FIG. 7 with a damper assembly in an intermediate position.
Figure 11B:
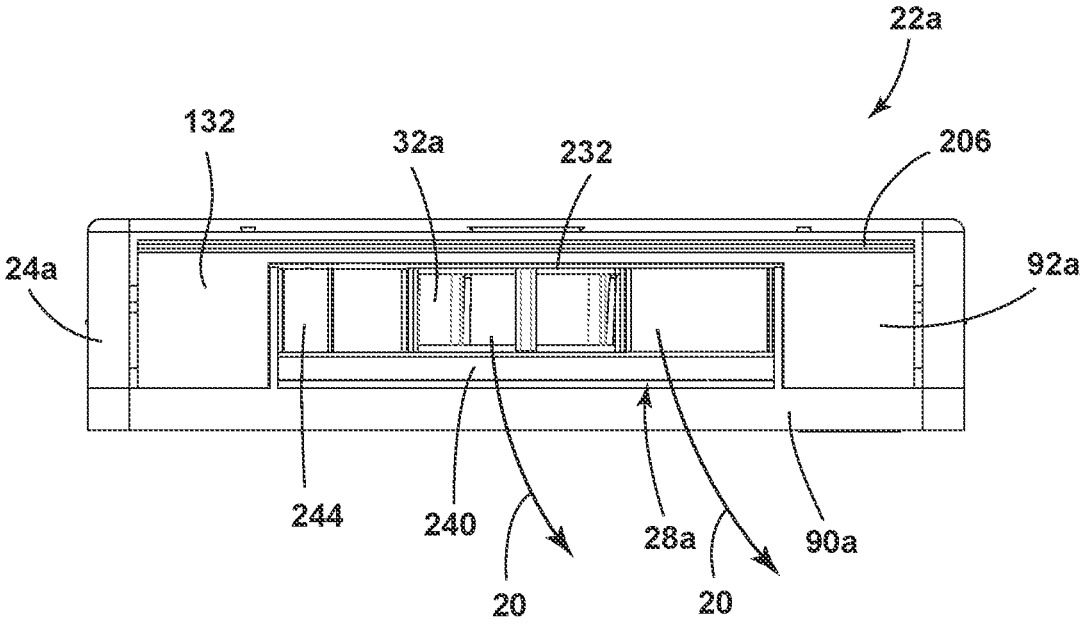
FIG. 11B is a second side elevation view of the fan assembly of FIG. 7 with a damper assembly in an intermediate position.
Figure 12:
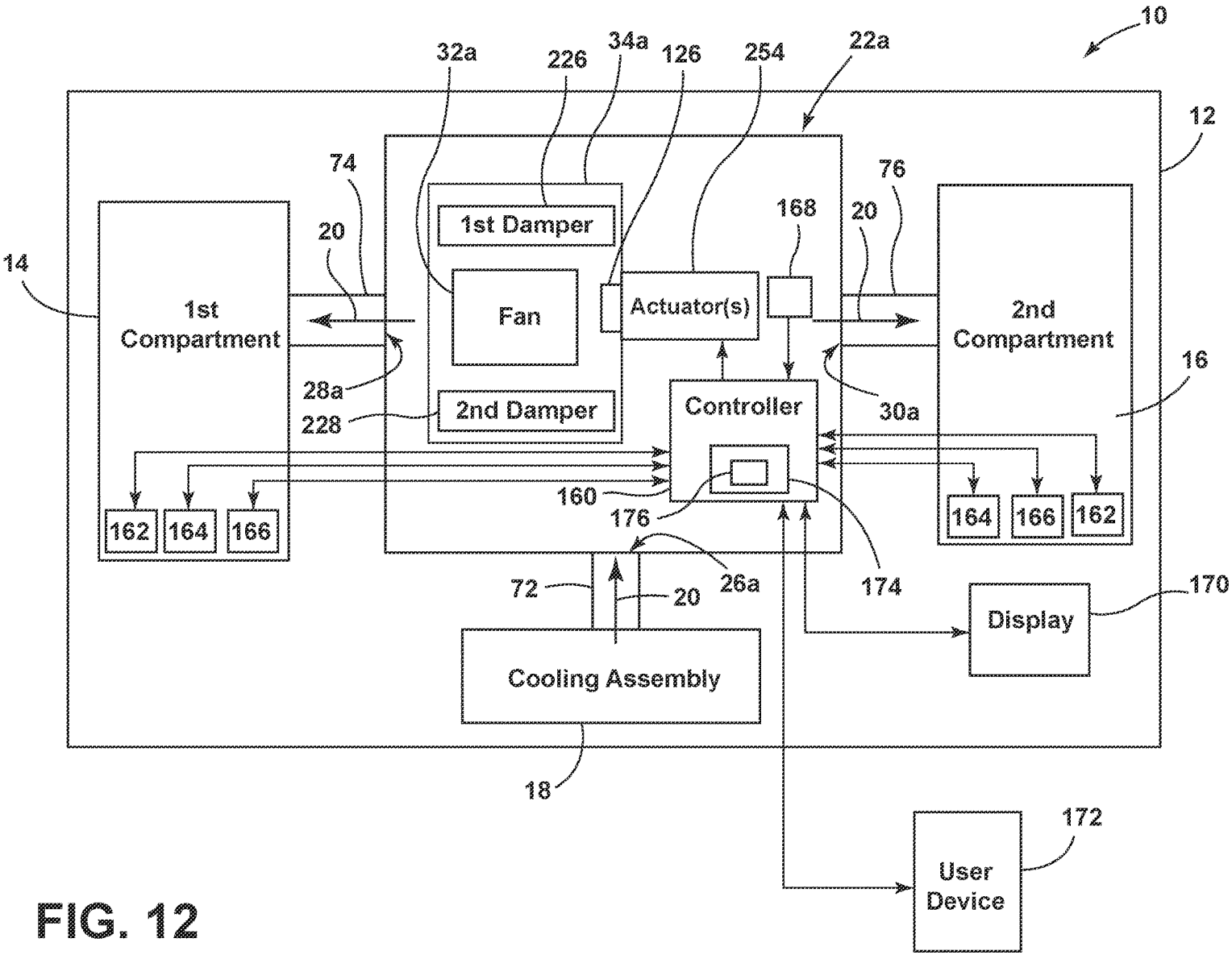
FIG. 12 is a schematic control diagram of the fan assembly of FIG. 7.

Referring now to FIGS. 7-11B, the actuation gear 256 is configured to rotate the first and second dampers 226, 228 of the damper assembly 34 between a first position (FIGS. 9A and 9B), a second position (FIGS. 10A and 10B), and an intermediate position (FIGS. 11A and 11B). The intermediate position may be any one of a plurality of intermediate positions between the first and second positions. When the damper assembly 34*a* is in the first position, the first and second stops 248, 250 are abutted within the first outlet 28*a* and the first and second sidewalls 236, 244 are positioned to obstruct the first outlet 28*a* of the housing 24*a* of the fan assembly 22*a*. Alternatively, the first and second stops 248, 250 of the first and second dampers 226, 228 can be positioned to meet within the first and second outlets 28*a*, 30*a* when the first and second dampers 226, 228 are rotated simultaneously. When the damper assembly 34*a* is in the second position, one or both of the first and second sidewalls 236, 244 are positioned to obstruct the second outlet 30*a* of the housing 24*a* of the fan assembly 22*a*.

As discussed previously, when the damper assembly 34*a* is in one of the first and second positions, the cooled air 20 is prevented from flowing through one of the respective outlets 28*a*, 30*a* and the respective compartment 14 or 16 is not cooled (FIGS. 2 and 3). When the damper assembly 34*a* is in one of the plurality of intermediate positions, each of the first and second sidewalls 236, 244 partially obstructs one or both of the first and second outlets 28*a*, 30*a*. In various examples, the obstruction of the first and second outlets 28*a*, 30*a* may be proportional such that when one-quarter of one of the outlets 28*a*, 30*a* are obstructed, three-quarters of the other outlets 28*a*, 30*a* are obstructed. Alternatively, the damper assembly 34*a* may be configured to provide unrelated obstruction of each of the first and second outlets 28*a*, 30*a*.

Referring now to FIGS. 7-12, the controller 160 is operably coupled with the actuator 254 and is configured to actuate the actuator 254 in response to input from a sensor (e.g., a temperature sensor 164, a door sensor 166, or any other sensor). As previously discussed, the sensors 164, 166 may correspond with either of the first compartment 14 or the second compartment 16. In various examples, each of the first and second compartments 14, 16 may include one or more separate sensors 164, 166. Alternatively, the controller 160 may be configured to actuate the actuator 254 based on a timed sequence regulated by the timer 168 such that the actuator 254 is actuated at predetermined time intervals. The controller 160 may further be actuated in response to user input from a display 170 or a user device 172 (e.g., an electronic device or a remote control). The user input may be configured to select one of the first position, the second position, or any one of a plurality of intermediate positions.

As previously introduced, the controller 160 includes the memory 174 configured to store the instructions 176. The instructions 176 allow the controller 160 to actuate the actuator 254 based on the received input. The controller 160 actuates the actuator 254 to rotate the actuation gear 256, and subsequently one or both of the first and second dampers 226, 228 of the damper assembly 34*a*, to provide obstruction of the first and second outlets 28*a*, 30*a* based on a selected or predetermined temperature. For example, if a user selects a first temperature for the first compartment 14, the controller 160 actuates the actuator 254 to rotate one or both of the first and second dampers 226, 228 of the damper assembly 34*a* to ensure that the appropriate first volume of cooled air 20 is provided to the first compartment 14. The controller 160 may also use input from the sensors 164, 166 to determine if the position of either of the first and second dampers 226, 228 of the damper assembly 34*a* should be changed to provide more or less cooled air 20 into the first compartment 14 based on the temperature of the first compartment 14 and/or the position of the door 56 to the first compartment 14. For example, when the door 56 is open, or just after the door 56 is closed, the controller 160 may actuate the actuator 254 to rotate the damper assembly 34*a* to allow a larger volume of the cooled air 20 into the first compartment 14.

The adjustable damper assembly 34*a* of the fan assembly 22*a* as discussed above allows a user to operate the refrigerator appliance 10 with the first compartment 14 as a refrigeration compartment and the second compartment 16 as a freezer compartment, with the first compartment 14 as a freezer compartment and the second compartment 16 as a refrigeration compartment, or both the first compartment 14 and the second compartment 16 as refrigeration compartments or freezer compartments. A user may also determine that one of the compartments 14, 16 is not needed and may block cooled air 20 from entering the selected compartment 14, 16. This provides a user more flexibility with regard to the use of the refrigeration appliance 10. The adjustable damper assembly 34*a* further allows the refrigeration appliance 10 to be configured to adjust the volume of cooled air 20 provided to either of the compartments 14, 16 to compensate for an open door of the appliance 10. This further allows for the refrigerator appliance 10 to use less energy cooling both compartments 14, 16 when only one compartment 14, 16 needs additional cooling.

Figure 13:
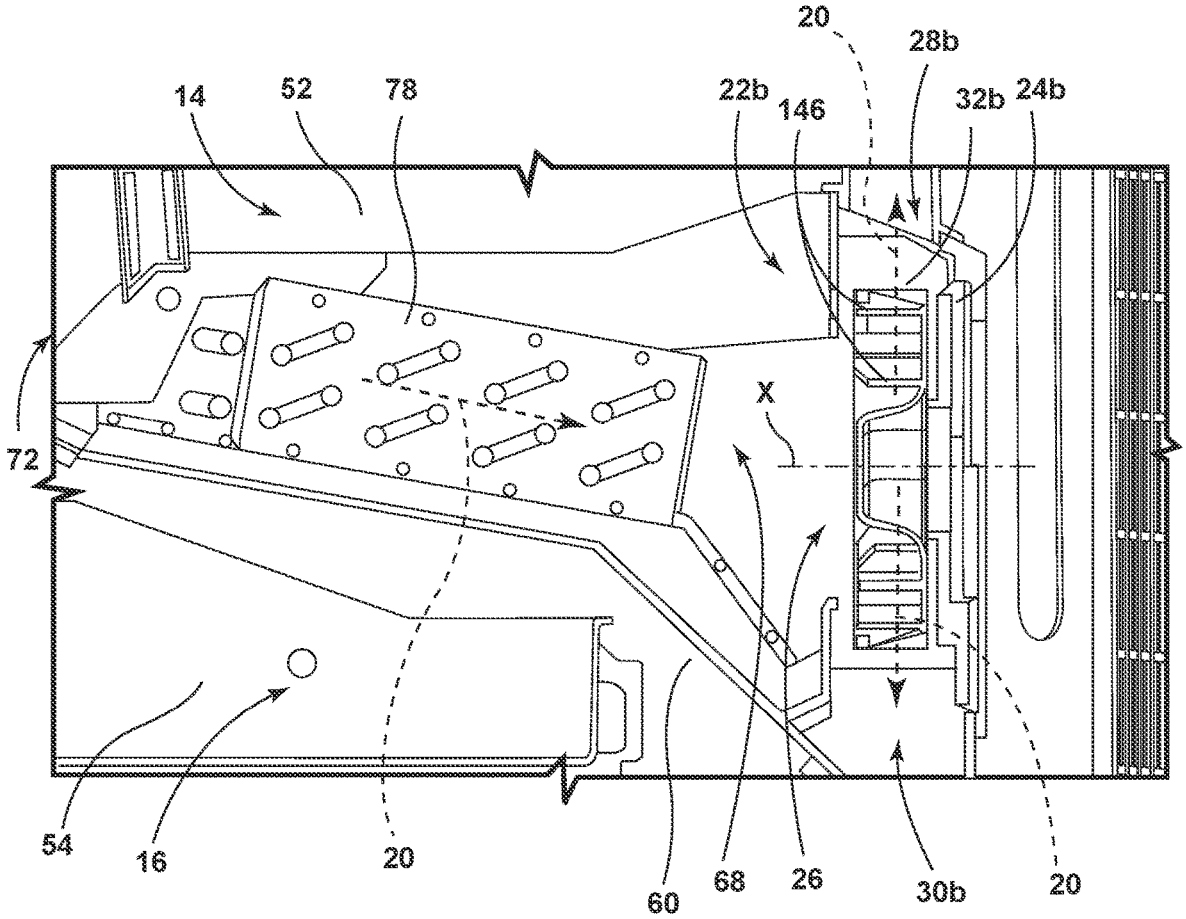
FIG. 13 is an enlarged cross-sectional view of a cooling assembly including a fan assembly, according to various examples.

Referring now to FIG. 13-16C, the fan assembly 22*b* is illustrated according to another exemplary embodiment. Where features of the fan assembly 22*b* are similar to the features of the fan assembly 22 and 22*a* illustrated in FIGS. 4-6 and 7-11B, respectively, the same or similar numbers have been used. In FIG. 13, the fan assembly 22*b* is illustrated positioned between the compartments 14, 16 of the appliance cabinet 12 and configured to direct air 20 into one or both of the compartments 14, 16, as described in more detail elsewhere herein.

Figure 14:
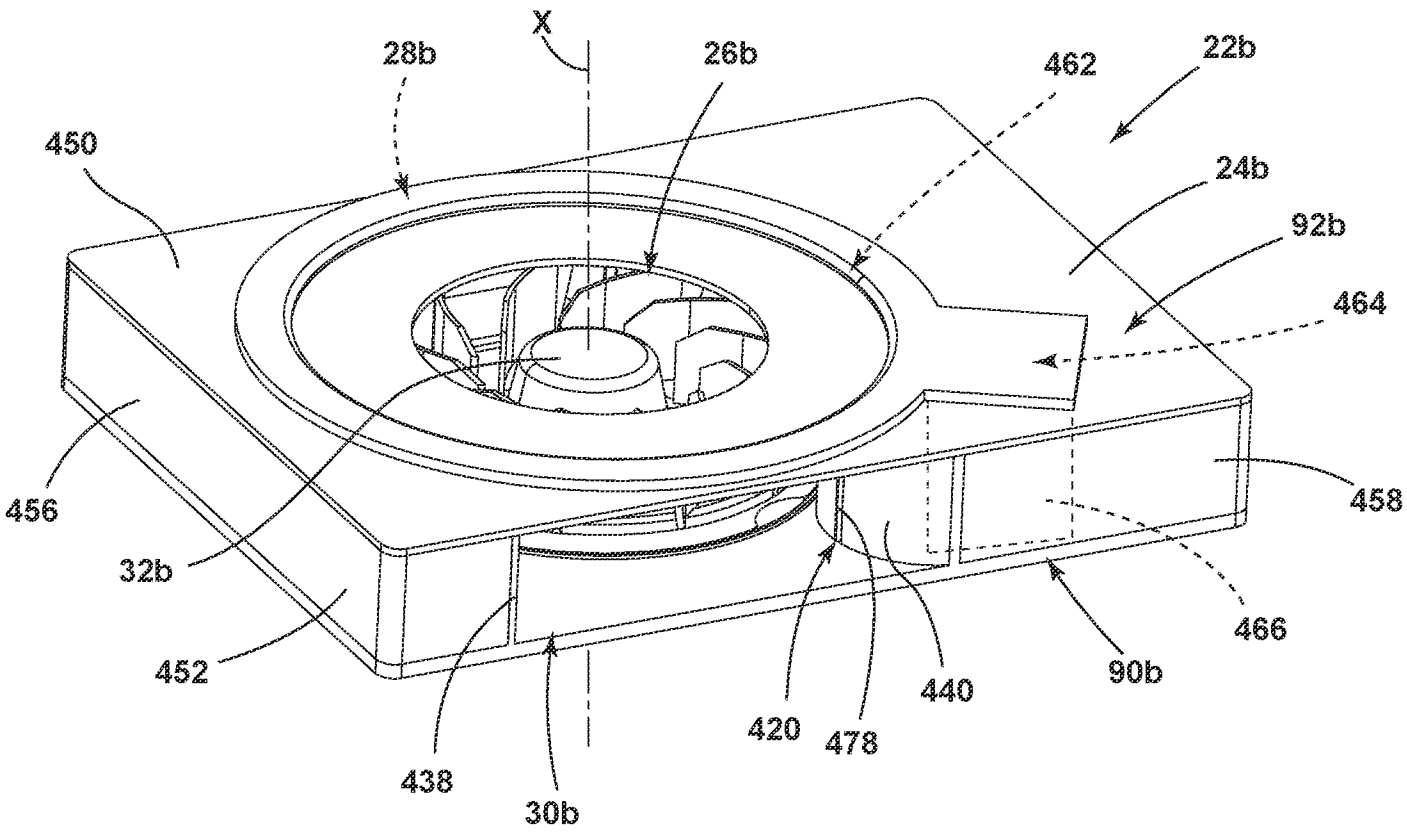
FIG. 14 is a top perspective view of a fan assembly, according to various examples.
Figure 15:
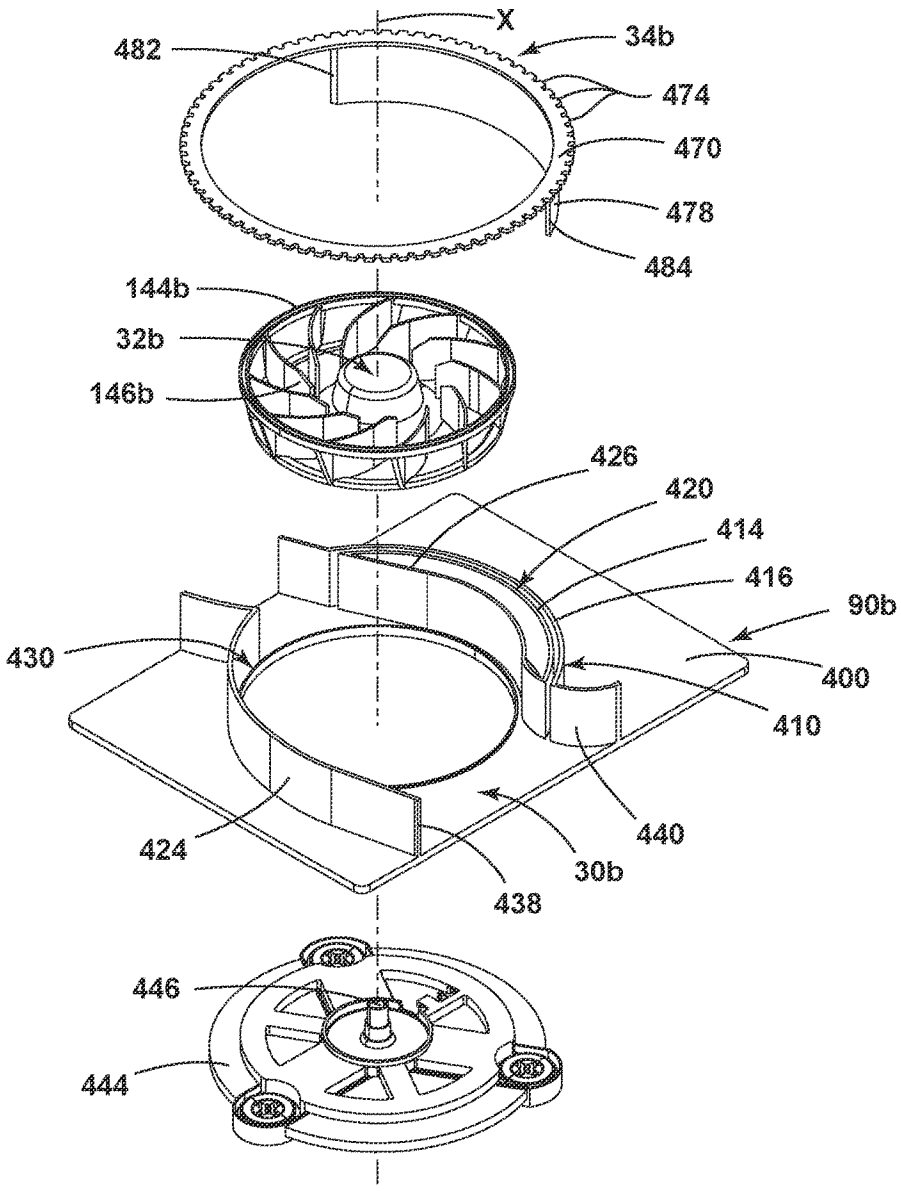
FIG. 15. is an exploded view of the fan assembly of FIG. 14 with a cover portion removed.

Referring now to FIGS. 14 and 15, the fan assembly 22*b* includes the housing 24*b* configured to enclose the fan 32*b* and the damper assembly 34*b*. The housing 24*b* includes the base portion 90*b* coupled with the cover portion 92*b*. As best illustrated in FIG. 15, the base portion 90*b* includes a base plate 400 and a damper guide 410 extending from the base plate 400. The damper guide 410 includes an inner arcuate portion 414 and an outer arcuate portion 416. The inner and outer arcuate portions 414, 416 define a receiving channel 420 therebetween configured to at least partially receive the damper assembly 34*b*, as discussed in more detail elsewhere herein.

The base portion 90*b* further includes a first inner wall 424 and a second inner wall 426. The first and second inner walls 424, 426 are configured to define a fan receiving space 430. As illustrated in FIG. 15, the second inner wall 426 may be integrally formed with the inner arcuate portion 414 of the damper guide 410. The first and second inner walls 424, 426 may be configured to at least partially direct air from the inlet 26*b* toward one or more of the outlets 28*b*, 30*b* (see FIG. 13).

The first outlet 28*b* may be framed by a first pair of outlet walls 434, 436. In other words, the first pair of outlet walls 434, 436 defines the first outlet 28*b*. One of the first pair of outlet walls 434, 436 may be integrally formed with the first inner wall 424 and the other of the first pair of outlet walls 434, 436 may be integrally formed with the outer arcuate portion 416 of the damper guide 410. The second outlet 30*b* may be framed by a second pair of outlet walls 438, 440. In other words, the second pair of outlet walls 438, 440 defines the second outlet 30*b*. One of the second pair of outlet walls 438, 440 may be integrally formed with the first inner wall 424, and the other of the second pair of outlet walls 438, 440 may be integrally formed with the outer arcuate portion 416 of the damper guide 410.

With continued reference to FIG. 15, the base portion 90*b* may further include a fan mount 444 operably coupled with the base plate 400. The fan mount 444 may include a pivot member 446 extending upward from the fan mount 444 and positioned along a central axis X of the fan receiving space 430. The fan 32*b* is configured to be rotatably coupled with the pivot member 446 such that the fan 32*b* is configured to rotate about the central axis X to pull cooled air 20 through the inlet 26*b* and direct the air 20 to one or more of the outlets 28*b*, 30*b* (see FIG. 13).

As shown in FIG. 14, the housing 24*b* further includes the cover portion 92*b* including a central plate 450 sized to complement the size and shape of the base plate 400 of the base portion 90*b*. A periphery wall 452 extends from at least a portion of a perimeter of the central plate 450 and includes first and second portions 456, 458. The first and second portions 456, 458 extend between the first pair of outlet walls 434, 436 and the second pair of outlet walls 438, 440 to at least partially enclose the housing 24*b* and frame the outlets 28*b*, 30*b*. The periphery wall 452 may be integrally formed with or may be coupled with the cover portion 92*b* and is further coupled with the base portion 90*b* when the housing 24*b* is assembled.

As previously introduced, the central plate 450 of the cover portion 92*b* defines the inlet 26*b*. When the housing 24*b* is assembled, the inlet 26*b* is centrally aligned with the central axis X of the fan 32*b* and is sized to draw cooled air 20 into the housing 24*b*. The central plate 450 of the cover portion 92*b* may further define a guide 462 extending at least partially about a periphery of the inlet 26*b*. The central plate 450 may further define an actuator space 464 in communication with the guide 462. When the fan assembly 22*b* is assembled, the guide 462 may be configured to at least partially receive the damper assembly 34*b*, and the actuator space 464 may be configured to at least partially receive an actuator 466, as described in more detail elsewhere herein.

Figure 16A:
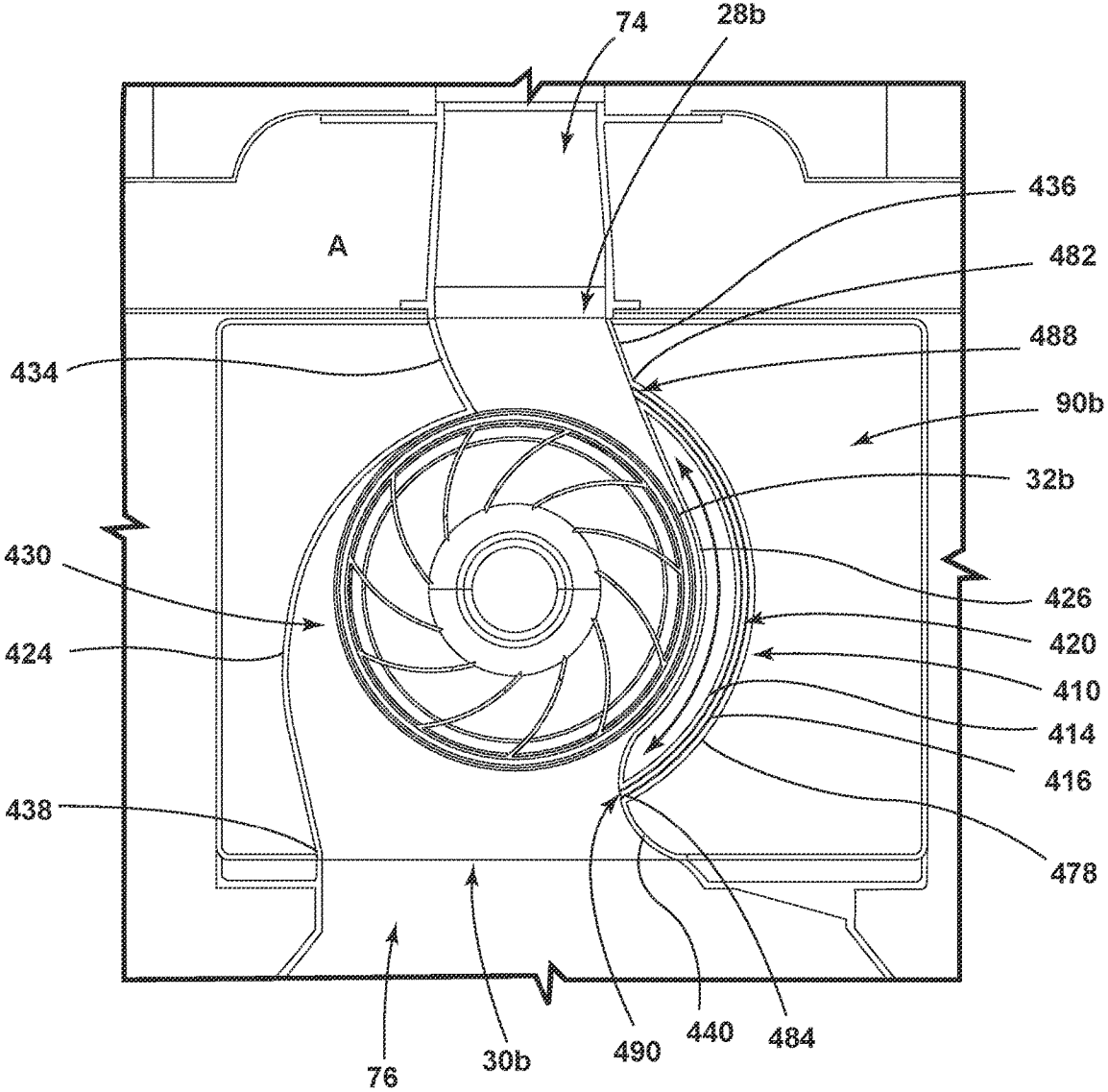
FIG. 16A is a top profile view of the fan assembly of FIG. 14 with a gear plate removed and a damper in a neutral position.
Figure 16B:
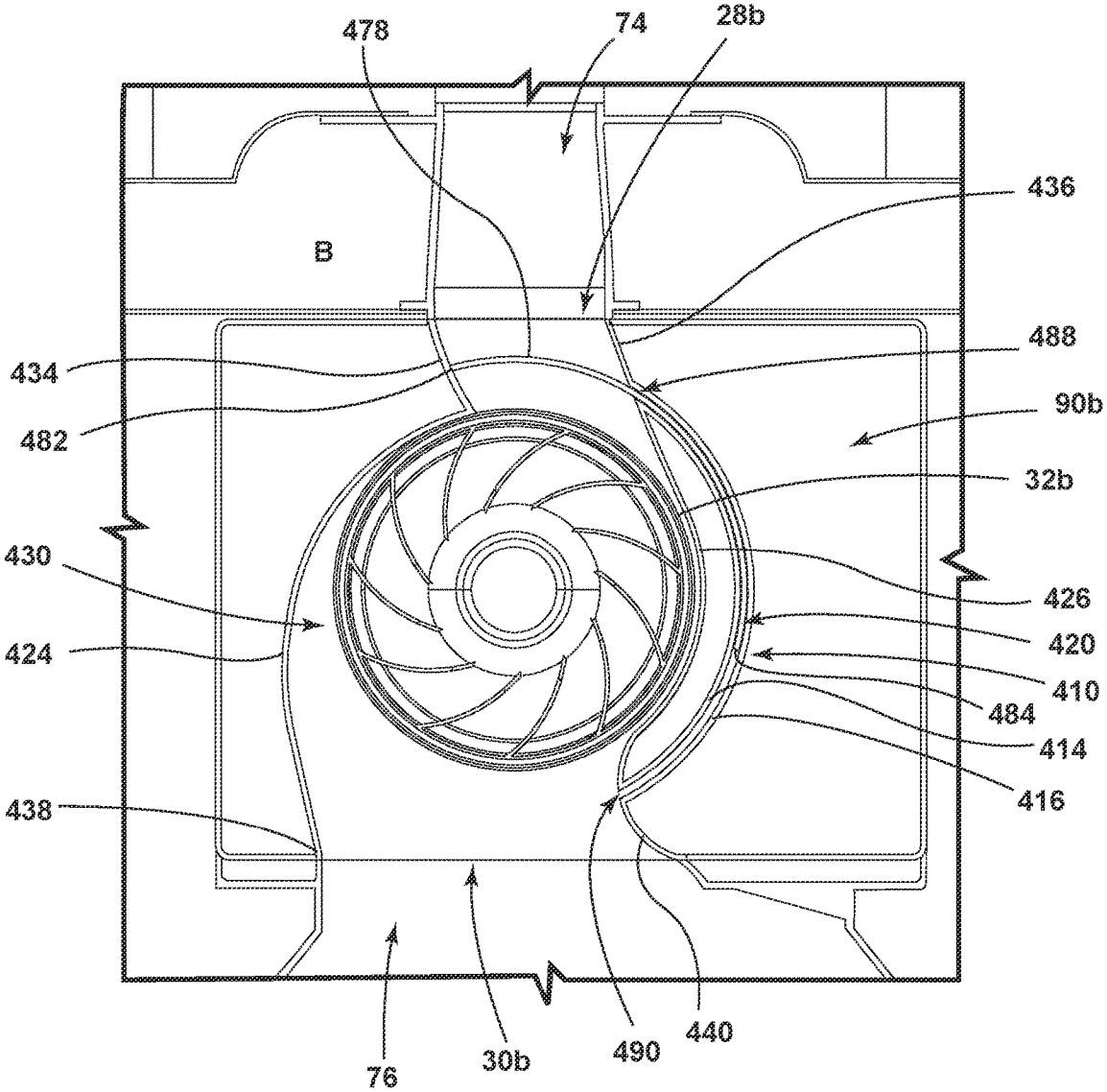
FIG. 16B is a top profile view of the fan assembly of FIG. 14 with a damper positioned so that a first outlet is obstructed.
Figure 16C:
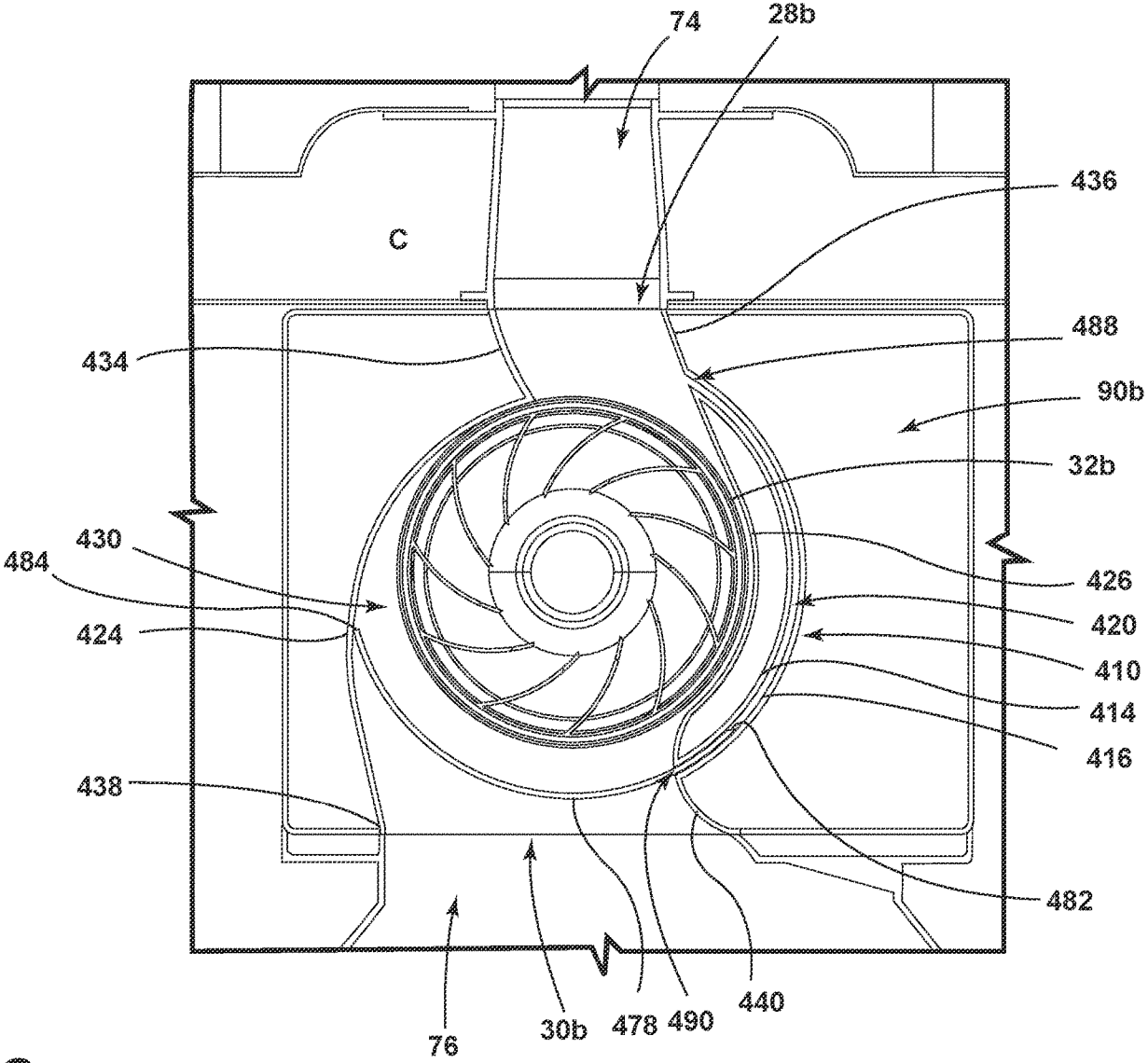
FIG. 16C is a top profile view of the fan assembly of FIG. 14 with a damper positioned so that a second outlet is obstructed.

As previously described with respect to the fan assembly 22 illustrated in FIG. 4-5C, the fan 32*b* is rotatably coupled with the base portion 90*b*. As illustrated in FIGS. 16A-16C, the fan 32*b* is positioned within the fan receiving space 430 and is configured to at least partially receive the pivot member 446 of the fan mount 444. In various examples, the fan 32*b* is configured to be rotated about the pivot member 446. In other examples, the pivot member 446 may be configured to actuate rotation of the fan 32*b*.

Referring again to FIG. 15, the fan 32*b* includes a fan rim 144*b*, and a plurality of fins 146*b* extend outward from a center of the fan 32*b* toward the fan rim 144*b* in an arcuate and outwardly radial pattern, sometimes referred to as a "sunburst" pattern. The fan 32*b* is configured to pull or otherwise direct the cooled air 20 from the inlet 26*b* of the housing 24*b* and direct the air 20 through the at least one of first and second outlets 28*b*, 30*b* of the housing 24*b* (see FIG. 13). It will be understood that the fan 32*b* and/or the pivot member 446 of the fan mount 444 may be conventionally operated by a motor and/or related electronics (e.g., a fan controller, a timer, etc.) without departing from the scope of the present disclosure.

Referring now to FIGS. 15 and 16A, the damper guide 410 is configured to receive the damper assembly 34*b*. The inner arcuate portion 414 and the outer arcuate portion 416 are spaced apart to define the receiving channel 420, as previously introduced. The receiving channel 420 is configured to at least partially receive the damper assembly 34*b* and is sized to allow rotation of the damper assembly 34*b* between a neutral position A (see FIG. 16A), a first position B (see FIG. 16B), and a second position C (see FIG. 16C).

The damper assembly 34*b* extends around the circumference of the fan 32*b* and is configured to rotate between the neutral position, the first position, and the second position. As shown in FIG. 15, the damper assembly 34*b* includes a rim 470 that defines a plurality of gear teeth 474 extending radially from the rim 470. In various examples, the plurality of gear teeth 474 may be integrally formed with the rim 470. In other examples, the plurality of gear teeth 474 may be integrally formed with a ring configured to be positioned about and/or coupled to the rim 470. The plurality of gear teeth 474 may be positioned along the entire circumference of the rim 470 or may be defined circumferentially along at least part of the circumference of the rim 470. The rim 470 and the plurality of gear teeth 474 may be positioned within the guide 462 of the central plate 450 of the cover 92*b* when the housing 24*b* of the fan assembly 22*b* is assembled.

Figure 17:
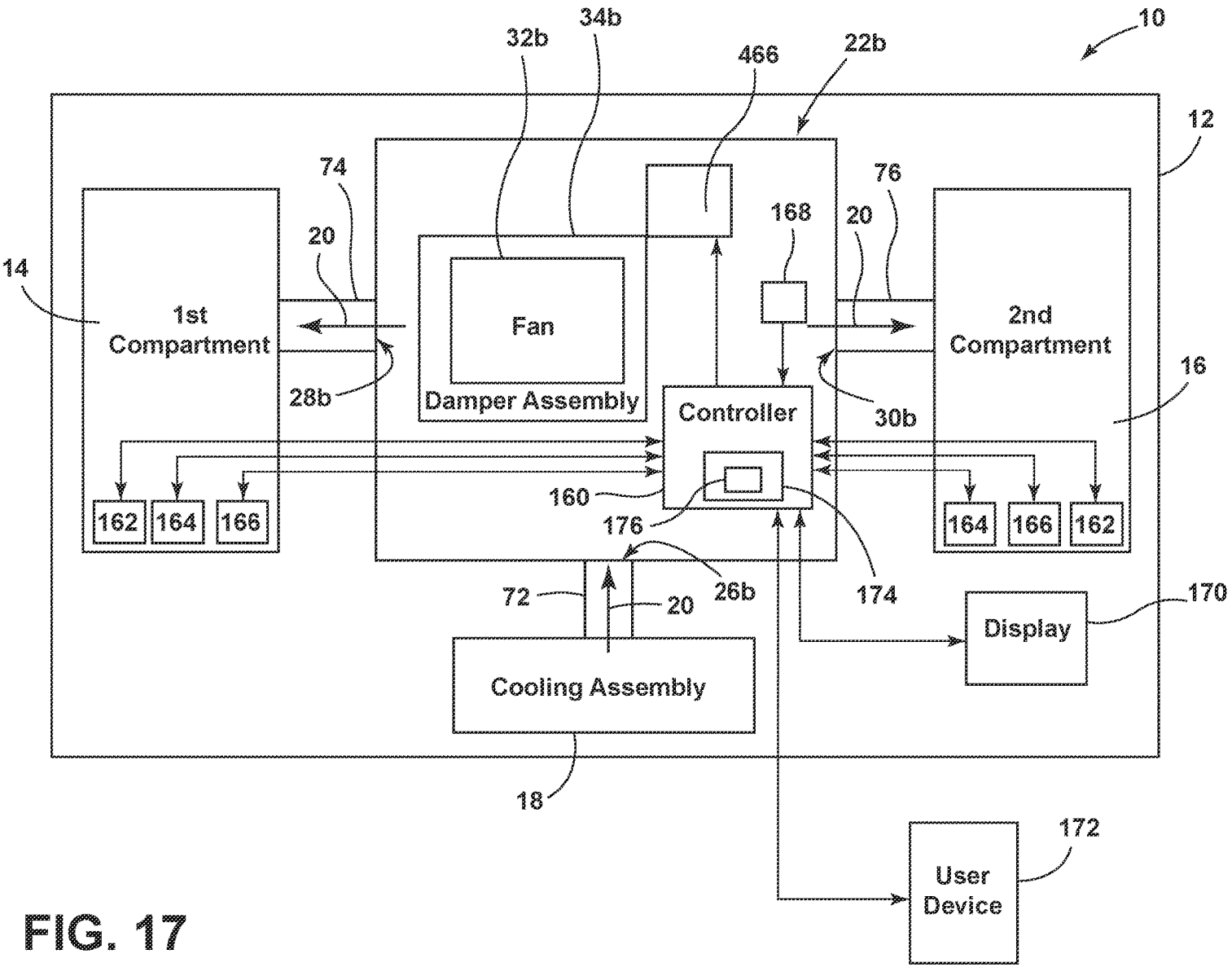
FIG. 17 is a schematic control diagram of the fan assembly of FIG. 14.

With reference now to FIGS. 14 and 17, an actuator 466 is configured to engage with the rim 470 of the damper assembly 34*b* to rotate the damper assembly 34*b* between the neutral position A, the first position B, and the second position C. The actuator 466 may be positioned proximate the damper assembly 34*b* and may be coupled with the base portion 90*b* of the housing 24*b*. The actuator 466 may be positioned to be at least partially received by the actuator space 464 of the central plate 450 of the cover 92*b*. It will be understood that the actuator 466 may be any actuator configured to engage with the rim 470 and rotate the damper assembly 34*b* in both clockwise and counterclockwise directions between the neutral position A, the first position B, and second position C.

As exemplified in FIGS. 15-16C, a sidewall 478 extends downward from the rim 470 and is slidably engaged with the receiving channel 420 defined by the inner and outer arcuate portions 414, 416 of the damper guide 410. The sidewall 478 extends circumferentially about a portion of the rim 470 of the damper assembly 34*b*, as illustrated in FIG. 15. For example, the sidewall 478 may extend along a quarter of the circumference of the rim 470, along half the circumference of the rim 38, along three-quarters of the circumference of the rim 470, or any other fraction of the circumference of the rim 470 so that the sidewall 478 is at least large enough to alternatively cover one of the first and second outlets 28*b*, 30*b* and small enough to be fully clear of the first and second outlets 28*b*, 30*b* and also to be fully received by the receiving channel 420 when the damper assembly 34*b* is in the neutral position A (see FIGS. 16A-16C).

Referring now to FIGS. 16A-16C, the sidewall 478 of the damper assembly 34*b* includes first and second ends 482, 484. When the damper assembly 34*b* is in the neutral position A, the first end 482 is positioned proximate a first opening 488 in communication with the receiving channel 420, and the second end 484 is portioned proximate a second opening 490 in communication with the receiving channel 420. When the damper assembly 34*b* is in the first position B, the sidewall 478 extends through the first opening 488 and the first end 482 of the sidewall 478 contacts one of the first pair of outlet walls 434. When the first end 482 contacts one of the first pair of outlet walls 434, the first outlet 28*b* is covered and airflow is prevent through the first outlet 28*b*. When the damper assembly 34*b* is in the first position C, the sidewall 478 extends through the second opening 490 and the second end 484 of the sidewall 478 contacts one of the second pair of outlet walls 438. When the second end 484 contacts one of the second pair of outlet walls 438, the second outlet 30*b* is covered and airflow is prevent through the second outlet 30*b*.

Referring now to FIGS. 13-17, the controller 160 is operably coupled with the actuator 466 and is configured to actuate the actuator 466 in response to input from a sensor (e.g., a temperature sensor 164, a door sensor 166, or any other sensor). As previously discussed, the sensors 164, 166 may correspond with either of the first compartment 14 or the second compartment 16. In various examples, each of the first and second compartments 14, 16 may include one or more separate sensors 164, 166. Alternatively, the controller 160 may be configured to actuate the actuator 466 based on a timed sequence regulated by the timer 168 such that the actuator 466 is actuated at predetermined time intervals. The controller 160 may further be actuated in response to user input from a display 170 or a user device 172 (e.g., an electronic device or a remote control). The user input may be configured to select one of the first position, the second position, or any one of a plurality of intermediate positions.

As previously introduced, the controller 160 includes the memory 174 configured to store the instructions 176. The instructions 176 allow the controller 160 to actuate the actuator 466 based on the received input. The controller 160 actuates the actuator 466 to operably rotate the damper assembly 34*b* to provide obstruction of the first and second outlets 28*b*, 30*b* based on a selected or predetermined temperature. For example, if a user selects a first temperature for the first compartment 14, the controller 160 actuates the actuator 466 to rotate the damper assembly 34*b* to ensure that the appropriate first volume of cooled air 20 is provided to the first compartment 14. The controller 160 may also use input from the sensors 164, 166 to determine if the position of the damper assembly 34*b* should be changed to provide more or less cooled air 20 into the first compartment 14 based on the temperature of the first compartment 14 and/or the position of the door 56 to the first compartment 14. For example, when the door 56 is open, or just after the door 56 is closed, the controller 160 may actuate the actuator 466 to rotate the damper assembly 34 to allow a larger volume of the cooled air 20 into the first compartment 14.

Figure 18:
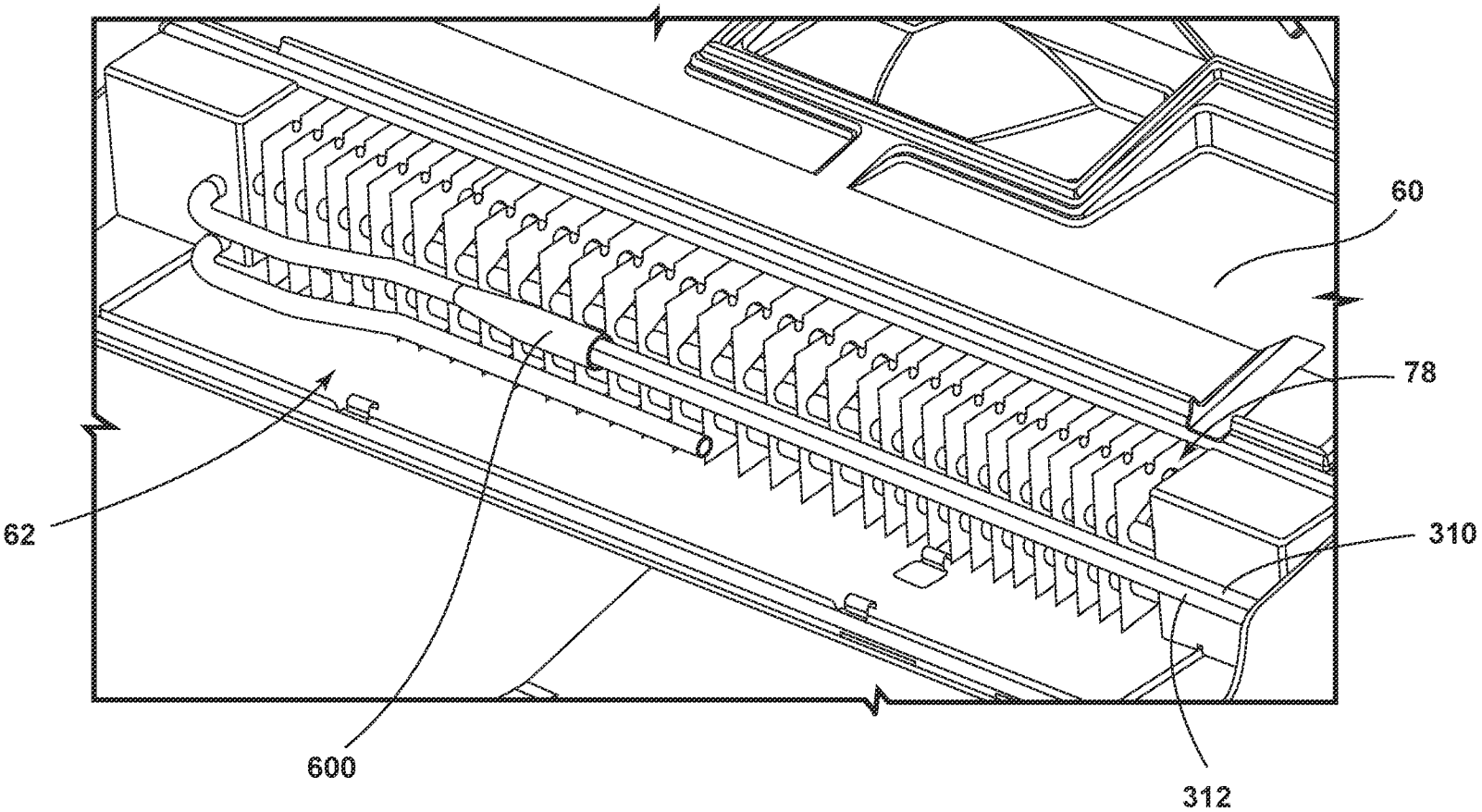
FIG. 18 is a top perspective view of an evaporator of the cooling assembly of FIG. 2.
Figure 19:
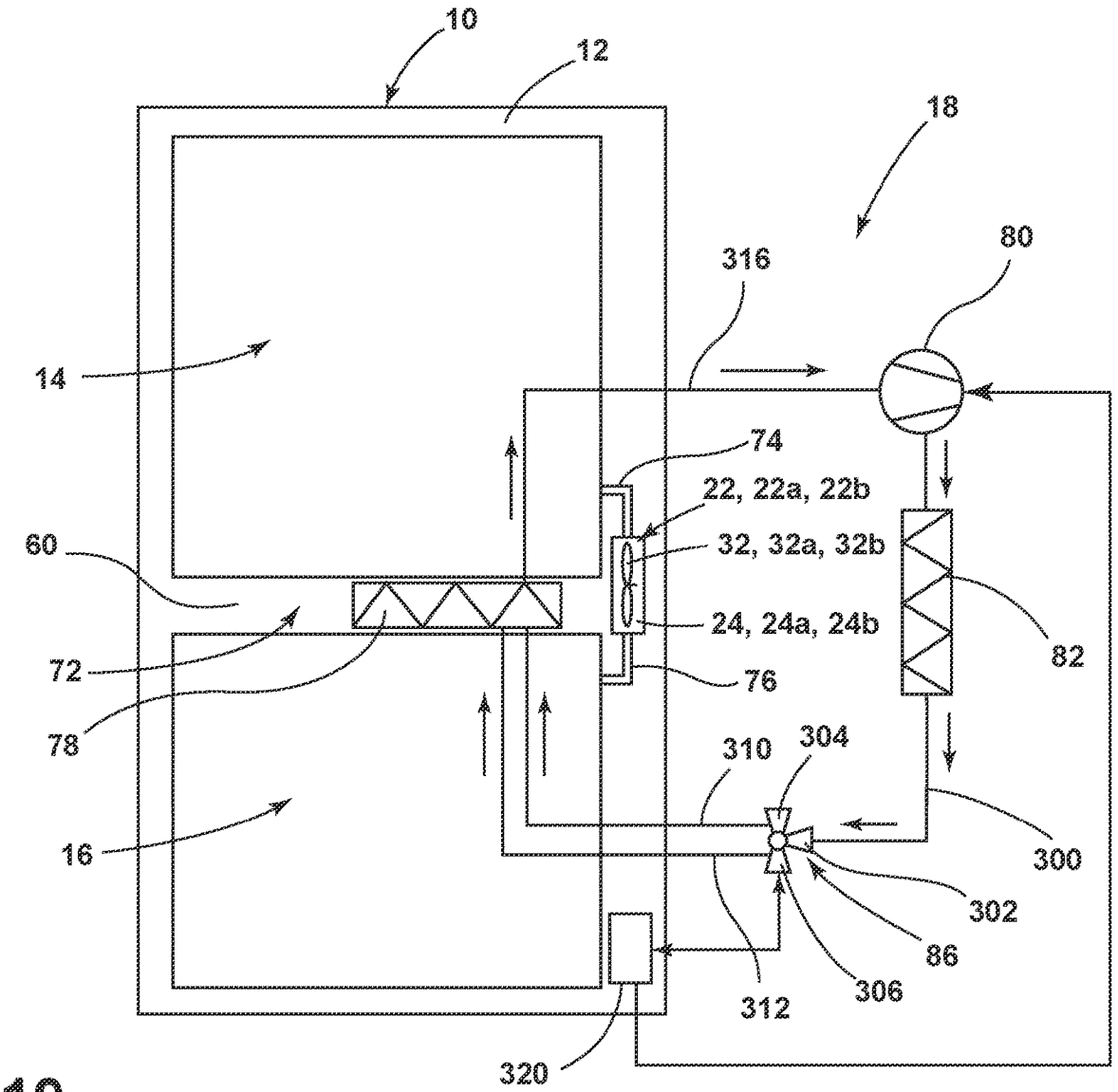
FIG. 19 is a schematic diagram of a cooling system including a fan assembly, according to various examples.

Referring now to FIGS. 18 and 19, the evaporator 78 of the cooling assembly 18 is illustrated having first and second inlet lines 310, 312 and an outlet line 316. As previously discussed, the cooling assembly 18 may use a single evaporator 78. As shown in FIGS. 2 and 3, the evaporator 78 may be positioned between the first and second compartments 14, 16 and within the mullion 60. As illustrated in FIG. 19, the evaporator 78 is selectively supplied with a thermal exchange media by a multi-directional valve 86. The thermal exchange media is supplied to the multi-directional valve 86 via a connection line 300 from the compressor 80 via the condenser 82. The multi-directional valve 86 corresponds to a 3-way electronic valve having an inlet port 302 and first and second outlet ports 304, 306. The first and second outlet ports 302, 304 are configured to selective supply the thermal exchange media to one of a first inlet line 310 and a second inlet line 312, respectively. A flow path of the thermal exchange media through the cooling assembly 18 is illustrated by the arrows shown in FIG. 19. In this configuration, the thermal exchange media may circulate through the cooling assembly 18 of the appliance 10.

Referring still to FIG. 19, a cooling system controller 320 may be incorporated into the cooling assembly 18 and may be configured to control the activation, duty cycle, and operation of the compressor 80 and the multi-directional valve 86. Additionally, the controller 320 may be configured to monitor temperature indications communicated via temperature sensors 164 disposed in each of the compartments 14, 16 and humidity indications communicated via humidity sensors 162 disposed in each of the compartments 14, 16. The controller 320 may comprise one or more logic control devices, integrated circuits, processors, and/or memory devices, which may be programmed with and/or configured to provide for the operation of the various control routines and methods of operation discussed herein.

The controller 320 may control the multi-directional valve 86 to provide the thermal exchange media to one of the first and second inlet lines 310, 312. As shown in FIGS. 18 and 19, the first and second inlet lines 310, 312 are operably coupled with the evaporator 78. The first and second inlet lines 310, 312 may be configured as capillary tubes. However, it is contemplated that the first and second inlet lines 310, 312 may be any conduit configured to provide the thermal exchange media to the evaporator 78 without departing from the scope of the present disclosure. As illustrated in FIG. 18, the lines 310, 312 may be positioned within a single casing 600. Alternatively, the lines 310, 312 may be separately enclosed or otherwise positioned to provide thermal exchange media to the evaporator 78. The first inlet line 310 is configured to provide the thermal exchange media to the evaporator 78 at a first flow rate, and the second inlet line 312 is configured to provide the thermal exchange media to the evaporator 78 at a second flow rate. The first flow rate is less than the second flow rate such that the first inlet line 310 provides thermal exchange media to the evaporator 78 at a lower rate than the second inlet line 312.

Referring now to FIGS. 1-19, when a temperature sensor 164 or humidity sensor 162 of one or both of the compartments 14, 16 indicates that cooling of the compartment 14, 16 is needed, the controller 320 is configured to actuate the cooling assembly 18. For example, where the first compartment 14 is being utilized as a refrigerator compartment and indicates that cooling is needed, the controller 320 is configured to control the multi-directional valve 86 to open the inlet port 302 and the first outlet port 304. The thermal exchange media may then flow along the connection line 300 from the condenser 82, through the multi-directional valve 86, and into the first inlet line 310. The first inlet line 310 provides the thermal exchange media to the evaporator 78 at the first flow rate. The first flow rate is configured to provide the thermal exchange media to the evaporator 78 such that the evaporator 78 is configured to cool the air pulled through the channel 72 by the fan assembly 22, 22*a* to a temperature between about 35° F. and about 20° F.

In another example, where the first compartment 14 is being utilized as a freezer compartment and indicates that cooling is needed, the controller 320 is configured to control the multi-direction valve 86 to open the inlet port 302 and the second outlet port 306. The thermal exchange media may then flow along the connection line 300 from the condenser 82, through the multi-directional valve 86, and into the second inlet line 312. The second inlet line 312 provides the thermal exchange media to the evaporator 78 at the second flow rate. The second flow rate is configured to provide the thermal exchange media to the evaporator 78 such that the evaporator 78 is configured to cool the air pulled through the channel 72 by the fan assembly 22, 22*a* to a temperature between about −20° F. and −30° F.

In yet another example, where the first compartment 14 is being utilized as a refrigerator compartment and the second compartment 16 is being utilized as a freezer compartment, the controller 320 is configured to is configured to control the multi-direction valve 86 to open the inlet port 302 and the second outlet port 306 such that the thermal exchange media may flow from the condenser 82, through the multi-directional valve 86, and into the second inlet line 312. The second inlet line 312 provides the thermal exchange media to the evaporator 78 at the second flow rate to cool the air pulled through the channel 72 by the fan assembly 22, 22*a*, 22*b*. In all examples, when the air is cooled by the evaporator 78, the cooled air 20 is directed by the fan assembly 22, 22*a*, 22*b* into one or both of the first and second compartments 14, 16. It is contemplated that the cooling system controller 320 may interact with or be integrated with the controller 160 of the fan assembly 22, 22*a*, 22*b* without departing from the scope of the present disclosure.

Utilizing a single evaporator 78 with two or more inlet lines 310, 312 provides cooled air 20 at various predetermined temperatures to the first and second compartments 14, 16. By adjusting the temperature of the cooled air 20 flowing into the first and second compartments 14, 16, the humidity and temperature of the compartments 14, 16 may be more readily controlled. For example, where one compartment 14, 16 is being utilized as a refrigerator compartment, the temperature of the cooled air 20 may be lowered to prevent adding humidity to the compartment 14, 16. Likewise, the energy required to cool the air to the lower temperature for cooling the compartment 14, 16 may be reduced by the lower temperature, which may result in energy savings and increased efficiency of the cooling assembly 18.

According to one aspect, a cooling assembly for a refrigerator appliance includes a housing that defines an inlet, a first outlet, and a second outlet. The first outlet is defined opposite the second outlet. A fan is positioned within the housing. The fan is configured to direct cooled air through the inlet and direct the cooled air toward the first and second outlets. A damper assembly is configured to rotate between a first position and a second position. The damper assembly includes a rim coupled with a plurality of gear teeth. The plurality of gear teeth are positioned circumferentially about, and extend radially from, the rim. A sidewall extends from a surface of the rim and extends circumferentially about a portion of a circumference of the rim. An actuator includes an actuation gear configured to be engaged with the plurality of gear teeth. The actuation gear is configured to rotate the damper assembly between the first and second positions.

According to another aspect, a sidewall of a damper assembly is configured to obstruct a first outlet when the damper assembly is in a first position and is configured to obstruct a second outlet when the damper assembly is in a second position.

According to another aspect, a damper assembly is configured to be moved to an intermediate position between first and second positions. A sidewall of the damper assembly is configured to at least partially obstruct one of first and second outlets when the damper assembly is in the intermediate position.

According to another aspect, a plurality of gear teeth are integrally formed with a rim.

According to another aspect, a plurality of gear teeth are integrally formed with a ring configured to be positioned about a rim.

According to another aspect, an inlet is substantially circular and axially aligned with the fan.

According to another aspect, a cooling assembly includes a controller configured to actuate an actuator in response to sensor input.

According to another aspect, a cooling assembly includes a controller configured to actuate the actuator in response to user input.

According to another aspect, a cooling assembly for a refrigerator appliance includes a housing defining an inlet, a first outlet, and a second outlet. The first outlet is defined distal from the second outlet. A fan is positioned within the housing. The fan is configured to direct cooled air through the inlet and toward the first and second outlets. A damper assembly is configured to selectively obstruct one of the first and second outlets by rotating between a first position and a second position. The damper assembly includes a first damper that has a first plurality of gear teeth extending from a first rim and a first sidewall that extends from the first rim parallel with the first plurality of gear teeth. A second damper has a second plurality of gear teeth extending from a second rim and a second sidewall that extends from the second rim parallel with the second plurality of gear teeth. The first and second dampers are positioned such that the first plurality of gear teeth extend towards the second plurality of gear teeth.

According to another aspect, a cooling assembly includes an actuator that has an actuation gear. The actuation gear is configured to be engaged with first and second pluralities of gear teeth and is positioned between first and second dampers.

According to another aspect, a first sidewall extends circumferentially about a portion of a first rim and a second sidewall extends circumferentially about a portion of a second rim.

According to another aspect, a first damper includes a first stop, and a second damper includes a second stop. The first and second stops are substantially flush when a damper assembly is in a first position.

According to another aspect, a refrigerator appliance includes a cabinet that defines first and second compartments. A fan assembly is configured to direct cooled air from a cooling assembly into the first and second compartments. The fan assembly includes a housing that defines an inlet, a first outlet, and a second outlet. The first outlet is in communication with the first compartment, and the second outlet is in communication with the second compartment. A fan is positioned within the housing and is configured to direct the cooled air from the inlet toward the first and second outlets. A damper assembly is configured to selectively obstruct one of the first outlet and the second outlet.

According to another aspect, a fan assembly includes an actuator configured to rotate a damper assembly between first and second positions.

According to another aspect, a damper assembly is configured to obstruct a first outlet in a first position and is configured to obstruct a second outlet in a second position.

According to another aspect, a damper assembly is movable to an intermediate position between the first and second positions. The damper assembly is configured to partially obstruct both first and second outlets when the damper assembly is positioned in the intermediate position.

According to another aspect, a housing defines a receiving channel, and a damper assembly is movable to an neutral position between first and second positions. The damper assembly is fully received by the receiving channel in the neutral position.

According to another aspect, a cooling assembly includes an evaporator positioned proximate an inlet of a housing, a first inlet line operably coupled with the evaporator and configured to provide a thermal exchange media at a first flow rate, and a second inlet line operably coupled with the evaporator and configured to provide the thermal exchange media at a second flow rate.

According to another aspect, a damper assembly includes a first damper that has a first rim with a first plurality of teeth and a first sidewall extending from the first rim. The first sidewall extends at least partially about a circumference of the first rim.

According to another aspect, a damper assembly includes a second damper that has a second rim with a second plurality of teeth and a second sidewall extending from the first rim. The second plurality of teeth extend toward a first plurality of teeth.

According to another aspect, a first plurality of teeth extend from a surface of a first rim parallel with a first sidewall.

According to another aspect, a first plurality of teeth extend radially from a first rim.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooling assembly for a refrigerator appliance, comprising:

a housing defining an inlet, a first outlet, and a second outlet, wherein the first outlet is defined opposite the second outlet;

an evaporator positioned proximate the inlet of the housing;

a first inlet line operably coupled with the evaporator and configured to provide thermal exchange media to the evaporator at a first flow rate;

a second inlet line operably coupled with the evaporator and configured to provide thermal exchange media to the evaporator at a second flow rate;

a fan positioned within the housing, wherein the fan is configured to direct cooled air through the inlet and toward the first and second outlets;

a damper assembly configured to rotate between a first position and a second position, the damper assembly including:

a rim coupled with a plurality of gear teeth positioned circumferentially about, and extending radially from, the rim; and a sidewall extending from a surface of the rim, wherein the sidewall extends circumferentially about a portion of a circumference of the rim; and an actuator including an actuation gear configured to be engaged with the plurality of gear teeth, wherein the actuation gear is configured to rotate the damper assembly between the first and second positions.

2. The cooling assembly of claim 1, wherein the sidewall of the damper assembly is configured to obstruct the first outlet when the damper assembly is in the first position and is configured to obstruct the second outlet when the damper assembly is in the second position.

3. The cooling assembly of claim 1, wherein the damper assembly is configured to be moved to an intermediate position between the first and second positions to at least partially obstruct one of the first and second outlets when the damper assembly is in the intermediate position.

4. The cooling assembly of claim 1, wherein the plurality of gear teeth are integrally formed with the rim.

5. The cooling assembly of claim 1, wherein the plurality of gear teeth are defined within a surface of the rim.

6. The cooling assembly of claim 1, wherein the inlet is substantially circular and axially aligned with the fan.

7. The cooling assembly of claim 1, further including:

a controller configured to actuate the actuator in response to sensor input.

8. The cooling assembly of claim 1, further comprising:

a controller configured to actuate the actuator in response to user input.

9. A cooling assembly for a refrigerator appliance, comprising:

a housing defining an inlet, a first outlet, and a second outlet, wherein the first outlet is defined distal from the second outlet;

a fan positioned within the housing, the fan configured to direct cooled air from the inlet and toward the first and second outlets; and a damper assembly configured to selectively obstruct one of the first and second outlets by rotating between a first position and a second position, the damper assembly including:

a first damper having a first plurality of gear teeth extending from a first rim and a first sidewall extending from the first rim parallel with the first plurality of gear teeth; and a second damper having a second plurality of gear teeth extending from a second rim and a second sidewall extending from the second rim parallel with the second plurality of gear teeth, wherein the first and second dampers are positioned such that the first plurality of gear teeth extend towards the second plurality of gear teeth.

10. The cooling assembly of claim 9, further comprising:

an actuator including an actuation gear configured to be engaged with the first and second pluralities of gear teeth, wherein the actuation gear is positioned between the first and second dampers.

11. The cooling assembly of claim 9, wherein the first sidewall extends circumferentially about a portion of the first rim and the second sidewall extends circumferentially about a portion of the second rim.

12. The cooling assembly of claim 9, wherein the first damper further includes a first stop and the second damper further includes a second stop, and further wherein the first and second stops are substantially flush when the damper assembly is in the first position.

13. A refrigerator appliance comprising:

a cabinet defining first and second compartments; and a fan assembly configured to direct cooled air from a cooling assembly into the first and second compartments, the fan assembly including:

a housing defining an inlet, a first outlet, and a second outlet, wherein the first outlet is in communication with the first compartment and the second outlet is in communication with the second compartment;

a fan positioned within the housing and configured to direct the cooled air from the inlet toward the first and second outlets; and a damper assembly configured to selectively and alternatively obstruct one of the first outlet and the second outlet, wherein the cooling assembly includes an evaporator positioned proximate the inlet of the housing, a first inlet line operably coupled with the evaporator and configured to provide thermal exchange media at a first flow rate, and a second inlet line operably coupled with the evaporator and configured to provide thermal exchange media at a second flow rate.

14. The refrigerator appliance of claim 13, wherein the fan assembly further includes an actuator configured to rotate the damper assembly between first and second positions, and wherein the damper assembly is configured to obstruct the first outlet in the first position and is configured to obstruct the second outlet in the second position.

15. The refrigerator appliance of claim 14, wherein the damper assembly is movable to an intermediate position between the first and second positions, and further wherein the damper assembly is configured to partially obstruct both of the first and second outlets when the damper assembly is positioned in the intermediate position.

16. The refrigerator appliance of claim 14, wherein the housing further defines a receiving channel and the damper assembly is movable to a neutral position between the first and second positions, and further wherein the damper assembly is fully received by the receiving channel in the neutral position.

17. The refrigerator appliance of claim 13, wherein the damper assembly includes a first damper having a first rim with a first plurality of teeth and a first sidewall extending from the first rim, and further wherein the first sidewall extends at least partially about a circumference of the first rim.

18. The refrigerator appliance of claim 17, wherein the damper assembly includes a second damper having a second rim with a second plurality of teeth and a second sidewall extending from the first rim, and further wherein the second plurality of teeth extend toward the first plurality of teeth.

19. The refrigerator appliance of claim 17, wherein the first plurality of teeth extend radially from the first rim.

* * * * *